US010887709B1

(12) United States Patent
Mansour et al.

(10) Patent No.: US 10,887,709 B1
(45) Date of Patent: Jan. 5, 2021

(54) ALIGNED BEAM MERGER

(71) Applicant: Amazon Technologies, Inc., Seattle, WA (US)

(72) Inventors: Mohamed Mansour, Cupertino, CA (US); Carlos Renato Nakagawa, San Jose, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 16/582,820

(22) Filed: Sep. 25, 2019

(51) Int. Cl.

| | |
|---|---|
| ***H04R 29/00*** | (2006.01) |
| ***G10K 11/34*** | (2006.01) |
| ***H04R 1/32*** | (2006.01) |
| ***G10L 21/0216*** | (2013.01) |
| ***H04R 3/00*** | (2006.01) |

(52) U.S. Cl.
CPC ..... *H04R 29/001* (2013.01); *G10K 11/34* (2013.01); *H04R 3/00* (2013.01); *G10L 2021/02166* (2013.01); *H04R 1/32* (2013.01); *H04R 2430/20* (2013.01)

(58) Field of Classification Search
CPC .... H04R 3/00; H04R 29/001; H04R 2430/20; H04R 1/32; H04R 1/326; G10K 11/34; G10K 11/343; G10L 2021/02166; G10L 2021/0232
USPC ..... 381/56, 97, 98, 91, 92, 122; 367/138, 367/199
See application file for complete search history.

(56) References Cited

U.S. PATENT DOCUMENTS

| | | | | |
|---|---|---|---|---|
| 5,808,967 | A * | 9/1998 | Yu | B06B 1/0629 367/91 |
| 9,456,276 | B1 * | 9/2016 | Chhetri | H04R 3/005 |
| 10,187,721 | B1 * | 1/2019 | Mansour | H04R 1/406 |
| 10,306,361 | B2 * | 5/2019 | Morton | H04R 1/406 |
| 10,366,702 | B2 * | 7/2019 | Morton | G10L 21/0202 |
| 10,598,543 | B1 * | 3/2020 | Mansour | H04R 3/005 |
| 10,657,981 | B1 * | 5/2020 | Mansour | H04R 1/2873 |
| 2004/0175006 | A1 * | 9/2004 | Kim | H04R 1/406 381/92 |
| 2008/0033726 | A1 * | 2/2008 | Kudoh | G10L 21/04 704/268 |
| 2012/0076316 | A1 * | 3/2012 | Zhu | G01S 3/801 381/71.11 |

* cited by examiner

*Primary Examiner* — Xu Mei
(74) *Attorney, Agent, or Firm* — Pierce Atwood LLP

(57) ABSTRACT

A system configured to perform aligned beam merger (ABM) processing to combine multiple beamformed signals. The system may capture audio data and perform beamforming to generate beamformed audio signals corresponding to a plurality of directions. The system may apply an ABM algorithm to select a number of the beamformed audio signals, align the selected audio signals, and merge the selected audio signals to generate a distortionless output audio signal. The system may scale the selected audio signals based on relative magnitude and apply a complex correction factor to compensate for a phase error for each of the selected audio signals.

20 Claims, 17 Drawing Sheets

FIG. 4

$$E_k(t,\omega) = (1.0 - \tau)E_k(t-1,\omega) + \tau\left\|x_k(t,\omega)\right\|^2$$

Energy Calculation
410

Playback Conditions
420

$$\Psi_k(t,\omega) = \frac{E_k(t,\omega)}{\min_k E_k(t,\omega)}$$

Playback SNR
Calculation
422

Non-Playback Conditions
430

$$\Psi_k(t,\omega) = \frac{E_k(t,\omega)}{E_k^{(slow)}(t,\omega)}$$

Non-Playback SNR
Calculation
432

FIG. 7

Scaling Value 710

$$\alpha_k(t,\omega) = \frac{\Psi_k(t,\omega)}{\sum_{l \in K} \Psi_l(t,\omega)} \quad \forall\, k \in K$$

Phase Value 720

$$\beta_k(t,\omega) = \angle\left\{\boldsymbol{h}_k^H(\omega)\,.\,\boldsymbol{d}(\omega,\ \theta_o)\right\}$$

Aligned Beam Merger 730

$$y(\omega) = \sum_k \alpha_k(\omega)\, e^{-j\beta_k(\omega)} y_k(\omega)$$

ALIGNED BEAM MERGER

BACKGROUND

With the advancement of technology, the use and popularity of electronic devices has increased considerably. Electronic devices are commonly used to capture and process audio data.

BRIEF DESCRIPTION OF DRAWINGS

For a more complete understanding of the present disclosure, reference is now made to the following description taken in conjunction with the accompanying drawings.

FIG. 4 illustrates examples of performing signal quality metric calculations according to embodiments of the present disclosure.

FIG. 7 illustrates examples of calculating scaling values and phase values and performing aligned beam merging processing according to embodiments of the present disclosure.

DETAILED DESCRIPTION

Electronic devices may be used to capture and process audio data. The audio data may be used for voice commands and/or may be output by loudspeakers as part of a communication session. In some examples, loudspeakers may generate audio using playback audio data while a microphone generates local audio data. An electronic device may perform audio processing, such as beamforming, acoustic echo cancellation (AEC), residual echo suppression (RES), adaptive interference cancellation (AIC), and/or the like, to remove an "echo" signal corresponding to the playback audio data from the local audio data, isolating local speech to be used for voice commands and/or the communication session.

In some examples, the device may perform beamforming to generate a plurality of directional audio signals and may select one or more of the directional audio signals to generate output audio data. When the device only selects a single directional audio signal as the output, the device can switch between individual beams erratically, causing some distortion. When the device selects multiple beams and combines the multiple beams to generate the output audio data, the output audio data may suffer from distortion and other signal degradation in the output audio data caused by phase mismatches from unaligned beams.

To improve beam selection and merging, devices, systems and methods are disclosed that perform aligned beam merger (ABM) processing to combine multiple beamformed signals. The system may capture audio data and perform beamforming to generate beamformed audio signals corresponding to a plurality of directions. The system may apply an ABM algorithm to select a number of the beamformed audio signals, align the selected audio signals, and merge the selected audio signals to generate a distortionless output audio signal. For example, the system may select one or more beams in each frequency band based on signal quality metric values and increment counter values associated with the selected beams. After processing all of the frequency bands using this technique, the system may select up to K best beams corresponding to the K highest counter values. The system may scale the selected audio signals based on relative magnitude and apply a complex correction factor to compensate for a phase error for each of the selected audio signals.

Figure 1:
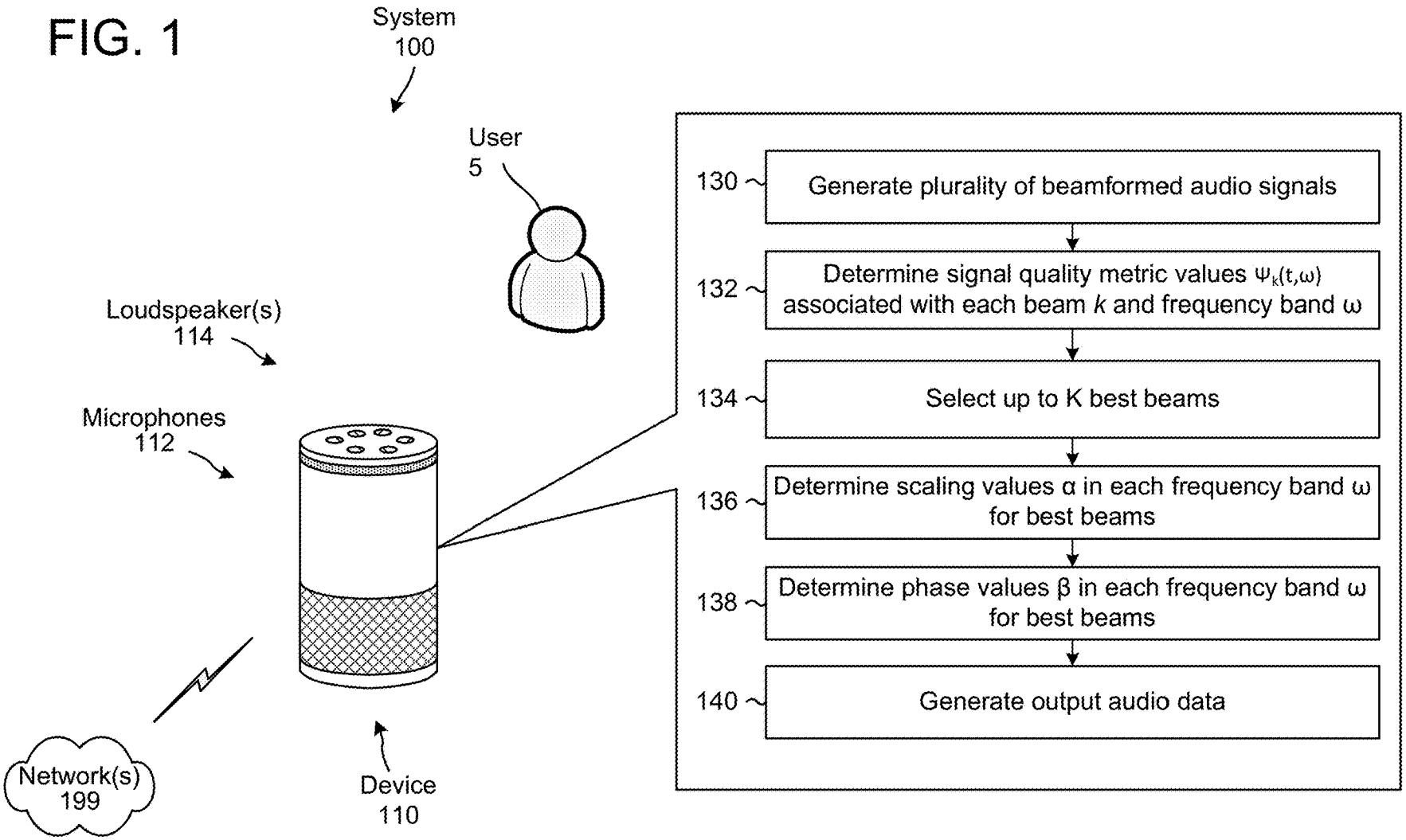
FIG. 1 illustrates a system according to embodiments of the present disclosure.

FIG. 1 illustrates a system configured to perform aligned beam merger processing according to embodiments of the present disclosure. For example, the system 100 may be configured to receive or generate beamformed audio signals and process the beamformed audio signals to generate an output audio signal. Although FIG. 1, and other figures/discussion illustrate the operation of the system in a particular order, the steps described may be performed in a different order (as well as certain steps removed or added) without departing from the intent of the disclosure. As illustrated in FIG. 1, the system 100 may include a device 110 that may be communicatively coupled to network(s) 199 and may include microphones 112 in a microphone array and/or one or more loudspeaker(s) 114. However, the disclosure is not limited thereto and the device 110 may include additional components without departing from the disclosure. While FIG. 1 illustrates the loudspeaker(s) 114 being internal to the device 110, the disclosure is not limited thereto and the loudspeaker(s) 114 may be external to the device 110 without departing from the disclosure. For example, the loudspeaker(s) 114 may be separate from the device 110 and connected to the device 110 via a wired connection and/or a wireless connection without departing from the disclosure.

The device 110 may be an electronic device configured to send audio data to and/or receive audio data. For example, the device 110 (e.g., local device) may receive playback audio data $x_r(t)$ (e.g., far-end reference audio data) from a remote device and the playback audio data $x_r(t)$ may include remote speech, music, and/or other output audio. In some examples, the user 5 may be listening to music or a program and the playback audio data $x_r(t)$ may include the music or other output audio (e.g., talk-radio, audio corresponding to a broadcast, text-to-speech output, etc.). However, the disclosure is not limited thereto and in other examples the user 5 may be involved in a communication session (e.g., conversation between the user 5 and a remote user local to the remote device) and the playback audio data $x_r(t)$ may include remote speech originating at the remote device. In both examples, the device 110 may generate output audio corresponding to the playback audio data $x_r(t)$ using the one or more loudspeaker(s) 114. While generating the output audio, the device 110 may capture microphone audio data $x_m(t)$ (e.g., input audio data) using the microphones 112. In addition to capturing desired speech (e.g., the microphone audio data includes a representation of local speech from a user 5), the device 110 may capture a portion of the output audio generated by the loudspeaker(s) 114 (including a portion of the music and/or remote speech), which may be referred to as an "echo" or echo signal, along with additional acoustic noise (e.g., undesired speech, ambient acoustic noise in an environment around the device 110, etc.), as discussed in greater detail below.

In some examples, the microphone audio data $x_m(t)$ may include a voice command directed to a remote system, which may be indicated by a keyword (e.g., wakeword). For example, the device 110 detect that the wakeword is represented in the microphone audio data $x_m(t)$ and may send the microphone audio data $x_m(t)$ to the remote system. Thus, the remote system may determine a voice command represented in the microphone audio data $x_m(t)$ and may perform an action corresponding to the voice command (e.g., execute a command, send an instruction to the device 110 and/or other devices to execute the command, etc.). In some examples, to determine the voice command the remote system may perform Automatic Speech Recognition (ASR) processing, Natural Language Understanding (NLU) processing and/or command processing. The voice commands may control the device 110, audio devices (e.g., play music over loudspeaker (s) 114, capture audio using microphones 112, or the like), multimedia devices (e.g., play videos using a display, such as a television, computer, tablet or the like), smart home devices (e.g., change temperature controls, turn on/off lights, lock/unlock doors, etc.) or the like.

Additionally or alternatively, in some examples the device 110 may send the microphone audio data $x_m(t)$ to the remote device as part of a Voice over Internet Protocol (VoIP) communication session or the like. For example, the device 110 may send the microphone audio data $x_m(t)$ to the remote device either directly or via remote system and may receive the playback audio data $x_r(t)$ from the remote device either directly or via the remote system. During the communication session, the device 110 may also detect the keyword (e.g., wakeword) represented in the microphone audio data $x_m(t)$ and send a portion of the microphone audio data $x_m(t)$ to the remote system in order for the remote system to determine a voice command.

Prior to sending the microphone audio data $x_m(t)$ to the remote device/remote system, the device 110 may perform audio processing to isolate local speech captured by the microphones 112 and/or to suppress unwanted audio data (e.g., echoes and/or noise). For example, the device 110 may perform beamforming (e.g., operate microphones 112 using beamforming techniques) to isolate speech or other input audio corresponding to target direction(s). Additionally or alternatively, the device 110 may perform acoustic echo cancellation (AEC), adaptive interference cancellation (AIC), residual echo suppression (RES), and/or other audio processing without departing from the disclosure.

In audio systems, beamforming refers to techniques that are used to isolate audio from a particular direction in a multi-directional audio capture system. Beamforming may be particularly useful when filtering out noise from non-desired directions. Beamforming may be used for various tasks, including isolating voice commands to be executed by a speech-processing system. One technique for beamforming involves boosting audio received from a desired direction while dampening audio received from a non-desired direction. In one example of a beamformer system, a fixed beamformer unit employs a filter-and-sum structure to boost an audio signal that originates from the desired direction (sometimes referred to as the look-direction) while largely attenuating audio signals that original from other directions. A fixed beamformer unit may effectively eliminate certain diffuse noise (e.g., undesirable audio), which is detectable in similar energies from various directions, but may be less effective in eliminating noise emanating from a single source in a particular non-desired direction. The beamformer unit may also incorporate an adaptive beamformer unit/noise canceller that can adaptively cancel noise from different directions depending on audio conditions.

To illustrate an example, the device 110 may perform beamforming using the input audio data to generate a plurality of audio signals (e.g., beamformed audio data) corresponding to particular directions. For example, the plurality of audio signals may include a first audio signal corresponding to a first direction, a second audio signal corresponding to a second direction, a third audio signal corresponding to a third direction, and so on. The device 110 may then process portions of the beamformed audio data separately to isolate the desired speech and/or remove or reduce noise.

In some examples, the device 110 may select beamformed audio data corresponding to two or more directions for further processing. For example, the device 110 may combine beamformed audio data corresponding to multiple directions and send the combined beamformed audio data to the remote device/remote system. As illustrated in FIG. 1, the device 110 may determine signal quality metric values, such as a signal-to-noise ratio (SNR) value, for individual directions (e.g., beams) and frequency bands and may use the signal quality metric values to select K beams (e.g., beamformed audio data corresponding to K different directions). As will be described in greater detail below, the device 110 may then determine scaling values $\alpha$ and phase values $\beta$ for each of the selected best beams and generate output audio data by performing aligned beam merger (ABM) processing. The ABM processing aligns the beams prior to merging, using the phase values (3, and therefore generates distortionless output audio data.

As illustrated in FIG. 1, the device 110 may generate (130) a plurality of beamformed audio signals (e.g., beamformed audio data, which may be referred to as beams) and determine (132)

signal quality metric values $\Psi_k(t, \omega)$ associated with each beam k and each frequency band $\omega$, as will be described in greater detail below with regard to FIG. 4. In some examples, in order to determine the signal quality metrics $\Psi_k(t, \omega)$, the device 110 may determine energy values $E_k(t, \omega)$ associated with each beam k and frequency band $\omega$, although the disclosure is not limited thereto. For example, the device 110 may convert audio data from a time domain to a frequency domain using a first number (e.g., 256) of different frequency bands, and may generate beamformed audio signals in a second number of directions (e.g., 12 directions or 12 beams), resulting in a third number (e.g., 12×256=3072) of energy values $E_k(t, \omega)$. However, the disclosure is not limited thereto, and the first number of frequency bands and/or the second number of beams may vary without departing from the disclosure.

In some examples, the device 110 may determine the signal quality metric values $\Psi_k(t, \omega)$ using a first technique during playback conditions (e.g., when the device 110 is outputting audio using the loudspeaker(s) 114) and using a second technique during non-playback conditions (e.g., when the device 110 is not outputting audio using the loudspeaker(s) 114, which may be referred to as "non-playback conditions"). For example, when the device 110 is generating output audio during playback conditions, the device 110 may determine the signal quality metric values $\Psi_k(t, \omega)$ by comparing the energy values $E_k(t, \omega)$ to a noise floor (e.g., minimum energy value across all beams). After detecting a wakeword represented in the input audio data, the device 110 may end playback and stop outputting the audio using the loudspeaker(s) 114, at which point the device 110 may determine the signal quality metric values $\Psi_k(t, \omega)$ as a ratio between fast-averaged energy values and slow-averaged energy values. For example, the device 110 may determine the fast-averaged energy values using a first time constant and determine the slow-averaged energy values using a second time constant that is much smaller than the first time constant.

Using the signal quality metric values $\Psi_k(t, \omega)$, the device 110 may select (134) up to K best beams using techniques described in greater detail below with regard to FIGS. 5A-5B. For example, the device 110 may select a signal quality metric value $\Psi_k(t, \omega)$ associated with a particular frequency band and particular beam and determine whether the signal quality metric value $\Psi_k(t, \omega)$ exceeds a threshold value. In some examples, the threshold value may be determined as a percentage of a highest signal quality metric value associated with the particular frequency band. If the signal quality metric value exceeds the threshold value, the device 110 may increment a counter value associated with the beam. For example, each individual beam may be associated with a corresponding counter that stores a respective counter value (e.g., 12 beams would correspond to 12 counters having 12 individual counter values). Thus, after processing all of the signal quality metric values $\Psi_k(t, \omega)$ for each beam and frequency band, the device 110 may determine counter values for each of the beams. For example, a first counter value for a first beam may indicate a number of frequency bands in which the first beam had a signal quality metric that satisfied a condition (e.g., exceeded a threshold value for the particular frequency band). The device 110 may then select a first number of beams (e.g., up to K best beams) associated with the K (e.g., 4, 6, etc.) highest counter values. For example, the device 110 may identify six of the highest counter values and select six beams that correspond to the six highest counter values, although the disclosure is not limited thereto.

The device 110 may determine (136) scaling values $\alpha$ for each frequency band $\omega$ for the best beams. For example, within each individual frequency band, the device 110 may compare a signal quality metric value associated with an individual beam of the best beams to a sum of all of the signal quality metric values for the best beams. Thus, the device 110 may take a scalar ratio for each of the best beams and use the scaling value to generate a weighted sum.

The device 110 may also determine (138) phase values $\beta$ in each frequency band $\omega$ for the best beams. For example, the device 110 may align each of the best beams with a single beam having the highest counter value of the best beams, as described below with regard to FIG. 7. The device 110 may generate (140) output audio data using the scaling values $\alpha$, the phase values $\beta$, and the beamformed audio data corresponding to the best beams.

As discussed above, the device 110 may perform beamforming (e.g., perform a beamforming operation to generate beamformed audio data corresponding to individual directions). As used herein, beamforming (e.g., performing a beamforming operation) corresponds to generating a plurality of directional audio signals (e.g., beamformed audio data) corresponding to individual directions relative to the microphone array. For example, the beamforming operation may individually filter input audio signals generated by multiple microphones 112 in the microphone array (e.g., first audio data associated with a first microphone, second audio data associated with a second microphone, etc.) in order to separate audio data associated with different directions. Thus, first beamformed audio data corresponds to audio data associated with a first direction, second beamformed audio data corresponds to audio data associated with a second direction, and so on. In some examples, the device 110 may generate the beamformed audio data by boosting an audio signal originating from the desired direction (e.g., look direction) while attenuating audio signals that originate from other directions, although the disclosure is not limited thereto.

To perform the beamforming operation, the device 110 may apply directional calculations to the input audio signals. In some examples, the device 110 may perform the directional calculations by applying filters to the input audio signals using filter coefficients associated with specific directions. For example, the device 110 may perform a first directional calculation by applying first filter coefficients to the input audio signals to generate the first beamformed audio data and may perform a second directional calculation by applying second filter coefficients to the input audio signals to generate the second beamformed audio data.

The filter coefficients used to perform the beamforming operation may be calculated offline (e.g., preconfigured ahead of time) and stored in the device 110. For example, the device 110 may store filter coefficients associated with hundreds of different directional calculations (e.g., hundreds of specific directions) and may select the desired filter coefficients for a particular beamforming operation at run-time (e.g., during the beamforming operation). To illustrate an example, at a first time the device 110 may perform a first beamforming operation to divide input audio data into 36 different portions, with each portion associated with a specific direction (e.g., 10 degrees out of 360 degrees) relative to the device 110. At a second time, however, the device 110 may perform a second beamforming operation to divide input audio data into 6 different portions, with each portion associated with a specific direction (e.g., 60 degrees out of 360 degrees) relative to the device 110.

These directional calculations may sometimes be referred to as "beams" by one of skill in the art, with a first directional calculation (e.g., first filter coefficients) being referred to as a "first beam" corresponding to the first direction, the second directional calculation (e.g., second filter coefficients) being referred to as a "second beam" corresponding to the second direction, and so on. Thus, the device 110 stores hundreds of "beams" (e.g., directional calculations and associated filter coefficients) and uses the "beams" to perform a beamforming operation and generate a plurality of beamformed audio signals. However, "beams" may also refer to the output of the beamforming operation (e.g., plurality of beamformed audio signals). Thus, a first beam may correspond to first beamformed audio data associated with the first direction (e.g., portions of the input audio signals corresponding to the first direction), a second beam may correspond to second beamformed audio data associated with the second direction (e.g., portions of the input audio signals corresponding to the second direction), and so on. For ease of explanation, as used herein "beams" refer to the beamformed audio signals that are generated by the beamforming operation. Therefore, a first beam corresponds to first audio data associated with a first direction, whereas a first directional calculation corresponds to the first filter coefficients used to generate the first beam.

An audio signal is a representation of sound and an electronic representation of an audio signal may be referred to as audio data, which may be analog and/or digital without departing from the disclosure. For ease of illustration, the disclosure may refer to either audio data (e.g., far-end reference audio data or playback audio data, microphone audio data, near-end reference data or input audio data, etc.) or audio signals (e.g., playback signal, far-end reference signal, microphone signal, near-end reference signal, etc.) interchangeably without departing from the disclosure. For example, some audio data may be referred to as playback audio data $x_r(t)$, microphone audio data $x_m(t)$, error audio data m(t), output audio data r(t), and/or the like. Additionally or alternatively, this audio data may be referred to as audio signals such as a playback signal $x_r(t)$, microphone signal $x_m(t)$, error signal m(t), output audio data r(t), and/or the like without departing from the disclosure.

Additionally or alternatively, portions of a signal may be referenced as a portion of the signal or as a separate signal and/or portions of audio data may be referenced as a portion of the audio data or as separate audio data. For example, a first audio signal may correspond to a first period of time (e.g., 30 seconds) and a portion of the first audio signal corresponding to a second period of time (e.g., 1 second) may be referred to as a first portion of the first audio signal or as a second audio signal without departing from the disclosure. Similarly, first audio data may correspond to the first period of time (e.g., 30 seconds) and a portion of the first audio data corresponding to the second period of time (e.g., 1 second) may be referred to as a first portion of the first audio data or second audio data without departing from the disclosure. Audio signals and audio data may be used interchangeably, as well; a first audio signal may correspond to the first period of time (e.g., 30 seconds) and a portion of the first audio signal corresponding to a second period of time (e.g., 1 second) may be referred to as first audio data without departing from the disclosure.

In some examples, audio data may be captured by the microphones 112 in the time-domain. However, the device 110 may convert the audio data to the frequency-domain or subband-domain in order to perform beamforming, aligned beam merger (ABM) processing, acoustic echo cancellation (AEC) processing, and/or additional audio processing without departing from the disclosure.

As used herein, audio signals or audio data (e.g., far-end reference audio data, near-end reference audio data, microphone audio data, or the like) may correspond to a specific range of frequency bands. For example, far-end reference audio data and/or near-end reference audio data may correspond to a human hearing range (e.g., 20 Hz-20 kHz), although the disclosure is not limited thereto.

As used herein, a frequency band corresponds to a frequency range having a starting frequency and an ending frequency. Thus, the total frequency range may be divided into a fixed number (e.g., 256, 512, etc.) of frequency ranges, with each frequency range referred to as a frequency band and corresponding to a uniform size. However, the disclosure is not limited thereto and the size of the frequency band may vary without departing from the disclosure.

Playback audio data $x_r(t)$ (e.g., far-end reference signal) corresponds to audio data that will be output by the loudspeaker(s) 114 to generate playback audio (e.g., echo signal y(t)). For example, the device 110 may stream music or output speech associated with a communication session (e.g., audio or video telecommunication). In some examples, the playback audio data may be referred to as far-end reference audio data, loudspeaker audio data, and/or the like without departing from the disclosure. For ease of illustration, the following description will refer to this audio data as playback audio data or reference audio data. As noted above, the playback audio data may be referred to as playback signal(s) $x_r(t)$ without departing from the disclosure.

Microphone audio data $x_m(t)$ corresponds to audio data that is captured by one or more microphones 112 prior to the device 110 performing audio processing such as AEC processing or beamforming. The microphone audio data $x_m(t)$ may include local speech s(t) (e.g., an utterance, such as near-end speech generated by the user 5), an "echo" signal y(t) (e.g., portion of the playback audio $x_r(t)$ captured by the microphones 112), acoustic noise n(t) (e.g., ambient noise in an environment around the device 110), and/or the like. As the microphone audio data is captured by the microphones 112 and captures audio input to the device 110, the microphone audio data may be referred to as input audio data, near-end audio data, and/or the like without departing from the disclosure. For ease of illustration, the following description will refer to this signal as microphone audio data. As noted above, the microphone audio data may be referred to as a microphone signal without departing from the disclosure.

An "echo" signal y(t) corresponds to a portion of the playback audio that reaches the microphones 112 (e.g., portion of audible sound(s) output by the loudspeaker(s) 114 that is recaptured by the microphones 112) and may be referred to as an echo or echo data y(t).

Isolated audio data corresponds to audio data after the device 110 performs audio processing (e.g., AIC processing, ANC processing, AEC processing, RES processing, and/or the like) to isolate the local speech s(t). For example, isolated audio data corresponds to the microphone audio data $x_m(t)$ after subtracting the reference signal(s) (e.g., using AEC processing), performing residual echo suppression (RES) processing, and/or other audio processing known to one of skill in the art. As noted above, the isolated audio data may be referred to as isolated audio signal(s) without departing from the disclosure, and one of skill in the art will recognize that audio data output by an AEC component may also be referred to as an error audio data m(t), error signal m(t) and/or the like.

Figure 2A:
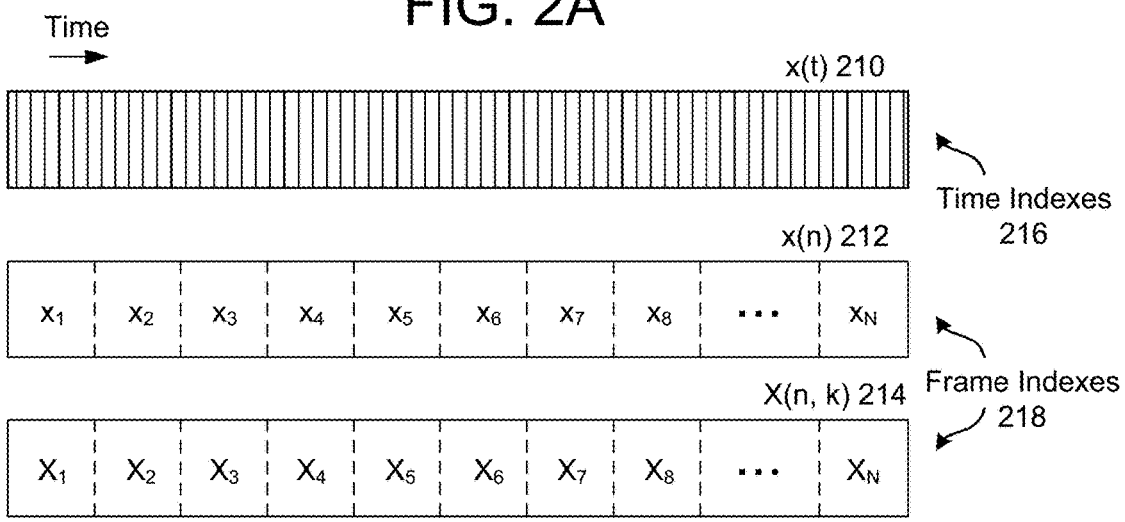
FIGS. 2A-2C illustrate examples of frame indexes, tone indexes, and channel indexes.
Figure 2B:
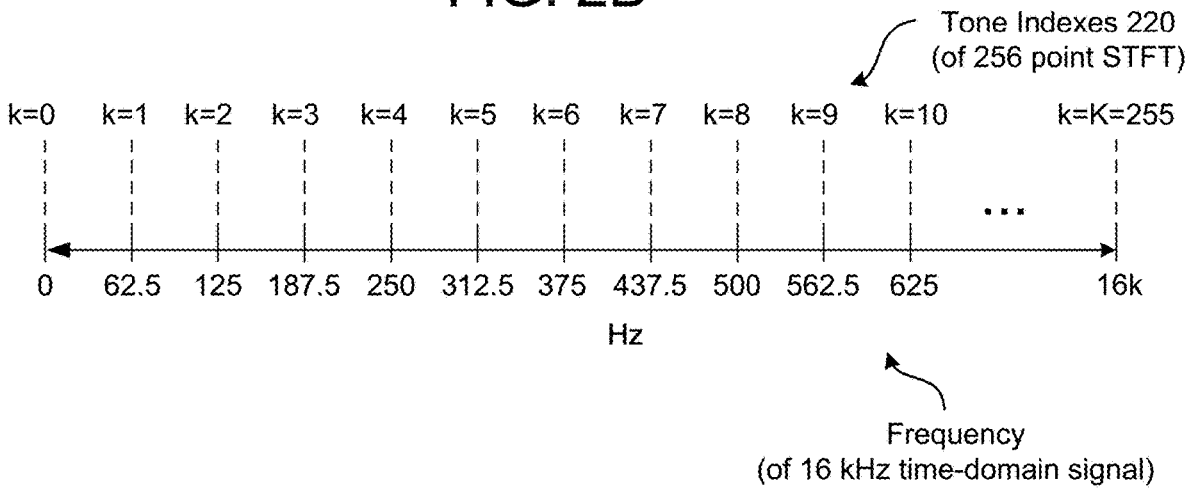
Figure 2C:
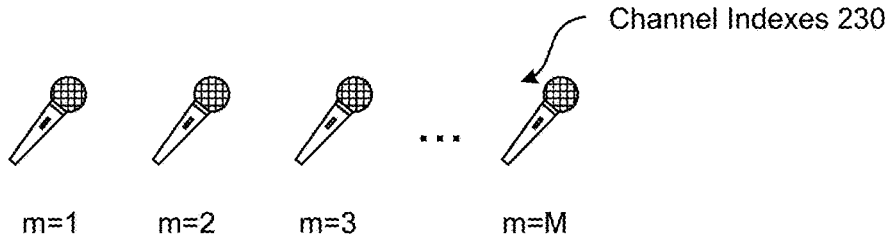

FIGS. 2A-2C illustrate examples of frame indexes, tone indexes, and channel indexes. As described above, the device 110 may generate microphone audio data $x_m(t)$ using microphones 112. For example, a first microphone 112*a* may generate first microphone audio data $x_{m1}(t)$ in a time domain, a second microphone 112*b* may generate second microphone audio data $x_{m2}(t)$ in the time domain, and so on. As illustrated in FIG. 2A, a time domain signal may be represented as microphone audio data x(t) 210, which is comprised of a sequence of individual samples of audio data. Thus, x(t) denotes an individual sample that is associated with a time t.

While the microphone audio data x(t) 210 is comprised of a plurality of samples, in some examples the device 110 may group a plurality of samples and process them together. As illustrated in FIG. 2A, the device 110 may group a number of samples together in a frame to generate microphone audio data x(n) 212. As used herein, a variable x(n) corresponds to the time-domain signal and identifies an individual frame (e.g., fixed number of samples s) associated with a frame index n.

Additionally or alternatively, the device 110 may convert microphone audio data x(n) 212 from the time domain to the frequency domain or subband domain. For example, the device 110 may perform Discrete Fourier Transforms (DFTs) (e.g., Fast Fourier transforms (FFTs), short-time Fourier Transforms (STFTs), and/or the like) to generate microphone audio data X(n, k) 214 in the frequency domain or the subband domain. As used herein, a variable X(n, k) corresponds to the frequency-domain signal and identifies an individual frame associated with frame index n and tone index k. As illustrated in FIG. 2A, the microphone audio data x(t) 212 corresponds to time indexes 216, whereas the microphone audio data x(n) 212 and the microphone audio data X(n, k) 214 corresponds to frame indexes 218.

A Fast Fourier Transform (FFT) is a Fourier-related transform used to determine the sinusoidal frequency and phase content of a signal, and performing FFT produces a one-dimensional vector of complex numbers. This vector can be used to calculate a two-dimensional matrix of frequency magnitude versus frequency. In some examples, the system 100 may perform FFT on individual frames of audio data and generate a one-dimensional and/or a two-dimensional matrix corresponding to the microphone audio data X(n). However, the disclosure is not limited thereto and the system 100 may instead perform short-time Fourier transform (STFT) operations without departing from the disclosure. A short-time Fourier transform is a Fourier-related transform used to determine the sinusoidal frequency and phase content of local sections of a signal as it changes over time.

Using a Fourier transform, a sound wave such as music or human speech can be broken down into its component "tones" of different frequencies, each tone represented by a sine wave of a different amplitude and phase. Whereas a time-domain sound wave (e.g., a sinusoid) would ordinarily be represented by the amplitude of the wave over time, a frequency domain representation of that same waveform comprises a plurality of discrete amplitude values, where each amplitude value is for a different tone or "bin." So, for example, if the sound wave consisted solely of a pure sinusoidal 1 kHz tone, then the frequency domain representation would consist of a discrete amplitude spike in the bin containing 1 kHz, with the other bins at zero. In other words, each tone "k" is a frequency index (e.g., frequency bin).

FIG. 2A illustrates an example of time indexes 216 (e.g., microphone audio data x(t) 210) and frame indexes 218 (e.g., microphone audio data x(n) 212 in the time domain and microphone audio data X(n, k) 216 in the frequency domain). For example, the system 100 may apply FFT processing to the time-domain microphone audio data x(n) 212, producing the frequency-domain microphone audio data X(n,k) 214, where the tone index "k" (e.g., frequency index) ranges from 0 to K and "n" is a frame index ranging from 0 to N. As illustrated in FIG. 2A, the history of the values across iterations is provided by the frame index "n", which ranges from 1 to N and represents a series of samples over time.

FIG. 2B illustrates an example of performing a K-point FFT on a time-domain signal. As illustrated in FIG. 2B, if a 256-point FFT is performed on a 16 kHz time-domain signal, the output is 256 complex numbers, where each complex number corresponds to a value at a frequency in increments of 16 kHz/256, such that there is 125 Hz between points, with point 0 corresponding to 0 Hz and point 255 corresponding to 16 kHz. As illustrated in FIG. 2B, each tone index 220 in the 256-point FFT corresponds to a frequency range (e.g., subband) in the 16 kHz time-domain signal. While FIG. 72B illustrates the frequency range being divided into 256 different subbands (e.g., tone indexes), the disclosure is not limited thereto and the system 100 may divide the frequency range into K different subbands (e.g., K indicates an FFT size). While FIG. 2B illustrates the tone index 220 being generated using a Fast Fourier Transform (FFT), the disclosure is not limited thereto. Instead, the tone index 220 may be generated using Short-Time Fourier Transform (STFT), generalized Discrete Fourier Transform (DFT) and/or other transforms known to one of skill in the art (e.g., discrete cosine transform, non-uniform filter bank, etc.).

The system 100 may include multiple microphones 112, with a first channel m corresponding to a first microphone 112*a*, a second channel (m+1) corresponding to a second microphone 112*b*, and so on until a final channel (MP) that corresponds to microphone 112M. FIG. 2C illustrates channel indexes 230 including a plurality of channels from channel m1 to channel M. While many drawings illustrate two channels (e.g., two microphones 112), the disclosure is not limited thereto and the number of channels may vary. For the purposes of discussion, an example of system 100 includes "M" microphones 112 (M>1) for hands free near-end/far-end distant speech recognition applications.

While FIGS. 2A-2C are described with reference to the microphone audio data $x_m(t)$, the disclosure is not limited thereto and the same techniques apply to the playback audio data $x_r(t)$ without departing from the disclosure. Thus, playback audio data $x_r(t)$ indicates a specific time index t from a series of samples in the time-domain, playback audio data $x_r(n)$ indicates a specific frame index n from series of frames in the time-domain, and playback audio data $X_r(n, k)$ indicates a specific frame index n and frequency index k from a series of frames in the frequency-domain.

Prior to converting the microphone audio data $x_m(n)$ and the playback audio data $x_r(n)$ to the frequency-domain, the device 110 may first perform time-alignment to align the playback audio data $x_r(n)$ with the microphone audio data $x_m(n)$. For example, due to nonlinearities and variable delays associated with sending the playback audio data $x_r(n)$ to the loudspeaker(s) 114 using a wireless connection, the playback audio data $x_r(n)$ is not synchronized with the microphone audio data $x_m(n)$. This lack of synchronization may be due to a propagation delay (e.g., fixed time delay) between the playback audio data $x_r(n)$ and the microphone audio data $x_m(n)$, clock jitter and/or clock skew (e.g., difference in sampling frequencies between the device 110 and the loudspeaker(s) 114), dropped packets (e.g., missing samples), and/or other variable delays.

To perform the time alignment, the device 110 may adjust the playback audio data $x_r(n)$ to match the microphone audio data $x_m(n)$. For example, the device 110 may adjust an offset between the playback audio data $x_r(n)$ and the microphone audio data $x_m(n)$ (e.g., adjust for propagation delay), may add/subtract samples and/or frames from the playback audio data $x_r(n)$ (e.g., adjust for drift), and/or the like. In some examples, the device 110 may modify both the microphone audio data and the playback audio data in order to synchronize the microphone audio data and the playback audio data. However, performing nonlinear modifications to the microphone audio data results in first microphone audio data associated with a first microphone to no longer be synchronized with second microphone audio data associated with a second microphone. Thus, the device 110 may instead modify only the playback audio data so that the playback audio data is synchronized with the first microphone audio data.

Figure 3A:
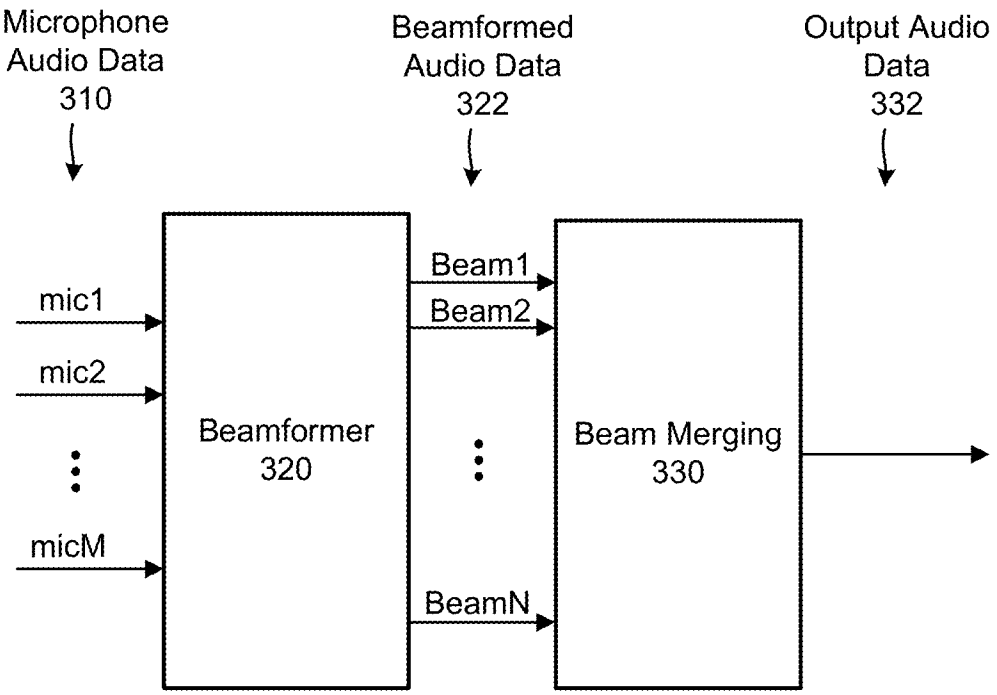
FIGS. 3A-3B illustrate example component diagrams according to embodiments of the present disclosure.
Figure 3B:
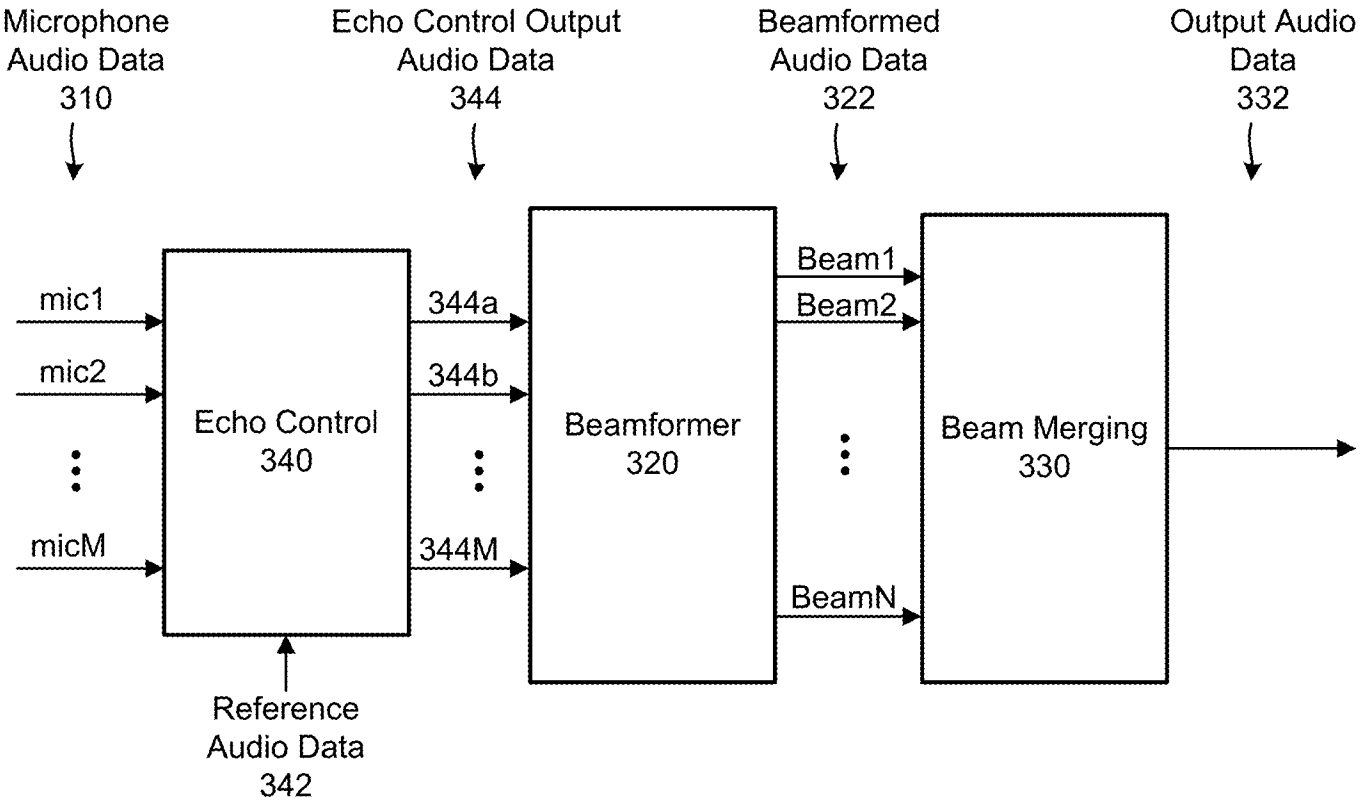

FIGS. 3A-3B illustrate example component diagrams according to embodiments of the present disclosure. As illustrated in FIG. 3A, the device 110 may receive microphone audio data 310 (e.g., mic1, mic2, . . . micM) from the microphones 112 and may input the microphone audio data 310 into a beamformer component 320. For example, the microphone audio data 310 may include an individual channel for each microphone, such as a first channel mic1 associated with a first microphone 112*a*, a second channel mic2 associated with a second microphone 112*b*, and so on until a final channel micM associated with an M-th microphone 112*m*.

The beamformer component 320 may perform beamforming to generate beamformed audio data 322 (e.g., Beam1, Beam2, . . . BeamN) corresponding to N different directions. For example, the beamformed audio data 322 may comprise a plurality of audio signals that includes a first audio signal corresponding to a first direction, a second audio signal corresponding to a second direction, a third audio signal corresponding to a third direction, and so on. The number of unique directions may vary without departing from the disclosure, and may be similar or different from the number of microphones 112.

The beamformed audio data 322 may be processed by a beam merging component 330 to generate output audio data 332. For example, the device 110 may apply techniques described above with regard to FIG. 1 and/or in greater detail below to generate the output audio data 332.

As illustrated in FIG. 3A, the device 110 may include a first number of microphones (e.g., M) and generate a second number of beams (e.g., N). However, the disclosure is not limited thereto and the device 110 may include any number of microphones and generate any number of beams without departing from the disclosure. Thus, the first number of microphones and the second number of beams may be the same or different without departing from the disclosure.

While FIG. 3A illustrates the beamformer component 320 performing beamforming processing on the microphone audio data 310, the disclosure is not limited thereto. In some examples, the device 110 may perform acoustic echo cancellation (AEC) processing and/or residual echo suppression (RES) processing prior to performing the beamforming processing.

As illustrated in FIG. 3B, an echo control component 340 may receive the microphone audio data 310 along with reference audio data 342 and may perform echo control processing to generate echo control output audio data 344 (e.g., 344*a*-344M). For example, the reference audio data 342 may correspond to playback audio data sent to the loudspeaker(s) 114 to generate output audio and the echo control component 340 may remove the reference audio data 342 from each of the microphone signals to generate the echo control output audio data 344. Thus, the echo control component 340 may generate a first channel of echo control output audio data 344*a* corresponding to the first microphone 112*a*, a second channel of echo control output audio data 344*b* corresponding to the second microphone 112*b*, and so on.

In some examples, the echo control component 340 may include a multi-channel acoustic echo canceller (MCAEC) component to perform echo cancellation. Additionally or alternatively, the echo control component may include a residual echo suppression (RES) component that may apply RES processing to suppress unwanted signals in a plurality of frequency bands using techniques known to one of skill in the art, although the disclosure is not limited thereto. For example, the RES component may generate a first channel of RES output audio data corresponding to the first microphone 112*a*, a second channel of RES output audio data corresponding to the second microphone 112*b*, and so on.

The beamformer component 320 may then receive the echo control output audio data 344 and perform beamforming to generate the beamformed audio data 322 without departing from the disclosure. For example, the beamformer component 320 may generate directional audio data corresponding to N unique directions (e.g., N unique beams).

In audio systems, acoustic echo cancellation (AEC) processing refers to techniques that are used to recognize when a device has recaptured sound via microphone(s) after some delay that the device previously output via loudspeaker(s). The device may perform AEC processing by subtracting a delayed version of the original audio signal (e.g., playback audio data $x_r(t)$) from the captured audio (e.g., microphone audio data $x_m(t)$), producing a version of the captured audio that ideally eliminates the "echo" of the original audio signal, leaving only new audio information. For example, if someone were singing karaoke into a microphone while prerecorded music is output by a loudspeaker, AEC processing can be used to remove any of the recorded music from the audio captured by the microphone, allowing the singer's voice to be amplified and output without also reproducing a delayed "echo" of the original music. As another example, a media player that accepts voice commands via a microphone can use AEC processing to remove reproduced sounds corresponding to output media that are captured by the microphone, making it easier to process input voice commands.

In conventional systems, a device may perform RES processing by attenuating the error signal m(t) generated by the AEC processing based on system conditions. For example, during a communication session the device may attenuate all frequency bands when only remote speech is present (e.g., far-end single-talk conditions) and pass all frequency bands when only local speech is present (e.g., near-end single-talk conditions). When both remote speech and local speech is present (e.g., double-talk conditions), the device may pass a first portion of the error signal m(t) and attenuate a second portion of the error signal m(t).

While not illustrated in FIG. 3A-3B, in some examples the device 110 may perform beamforming prior to performing AEC processing. For example, the device 110 may perform AEC processing to the beamformed audio data 322 to remove the reference audio data 342 prior to the beam merging component 330 without departing from the disclosure.

In addition to or as an alternative to generating the reference signal based on the playback audio data, Adaptive Reference Algorithm (ARA) processing may generate an adaptive reference signal based on the input audio data. To illustrate an example, the ARA processing may select a first beamformed audio signal 322*a* as a target signal (e.g., the first beamformed audio signal 322*a* including a representation of speech) and a second beamformed audio signal 322*b* as a reference signal (e.g., the second beamformed audio signal 322*b* including a representation of the echo and/or other acoustic noise) and may perform Adaptive Interference Cancellation (AIC) (e.g., adaptive acoustic interference cancellation) by removing the reference signal from the target signal. As the second beamformed audio data 322*b* is not limited to a portion of the playback audio signal (e.g., echo signal), the ARA processing may remove other acoustic noise represented in the first beamformed audio signal 322*a* in addition to removing the echo signal. Therefore, the ARA processing may be referred to as performing AIC, adaptive noise cancellation (ANC), AEC, and/or the like without departing from the disclosure.

The device 110 may include an adaptive beamformer and may be configured to perform AIC using the ARA processing to isolate the speech in the input audio data. The adaptive beamformer may dynamically select target signal(s) and/or reference signal(s). Thus, the target signal(s) and/or the reference signal(s) may be continually changing over time based on speech, acoustic noise(s), ambient noise(s), and/or the like in an environment around the device 110. For example, the adaptive beamformer may select the target signal(s) by detecting speech, based on signal strength values or signal quality metrics (e.g., signal-to-noise ratio (SNR) values, average power values, etc.), and/or using other techniques or inputs, although the disclosure is not limited thereto. As an example of other techniques or inputs, the device 110 may capture video data corresponding to the input audio data, analyze the video data using computer vision processing (e.g., facial recognition, object recognition, or the like) to determine that a user is associated with a first direction, and select the target signal(s) by selecting the first audio signal corresponding to the first direction. Similarly, the adaptive beamformer may identify the reference signal(s) based on the signal strength values and/or using other inputs without departing from the disclosure. Thus, the target signal(s) and/or the reference signal(s) selected by the adaptive beamformer may vary, resulting in different filter coefficient values over time.

Additionally or alternatively, the device 110 may perform beam merging 330 to generate output audio data 332 and may perform echo cancellation on the output audio data 332. In some examples, the device 110 may apply traditional AEC processing to remove the reference audio data 344 (e.g., playback audio data) from the output audio data 332 as described above, but the disclosure is not limited thereto. In other examples, the device 110 may perform AIC processing to remove a portion of the beamformed audio data 322 and/or the microphone audio data 310 from the output audio data 332 without departing from the disclosure. Additionally or alternatively, the device 110 may perform second aligned beam merger (ABM) processing using different parameters to generate a reference audio signal without departing from the disclosure. For example, the device 110 may perform ABM processing to select beams having lowest counter values and generate a reference audio signal corresponding to a noise floor. Thus, the second output audio data generated using the lowest counter values may be removed from the output audio data 332 during AIC processing without departing from the disclosure.

FIG. 4 illustrates examples of performing signal quality metric calculations according to embodiments of the present disclosure. As illustrated in FIG. 4, the device 110 may determine a signal quality metric value $\Psi_k(t, \omega)$ (e.g., signal-to-noise ratio (SNR)) value associated with an individual beam k and frequency band w using energy calculation 410 and one of playback SNR calculation 422 or non-playback SNR calculation 432. For example, the device 110 may determine energy values $E_k(t, \omega)$ using energy calculation 410, shown below:

$$E_k(t,\omega)=(1.0-\tau)E_k(t-1,\omega)+\tau\|x_k(t,\omega)\|^2 \quad [1]$$

where $E_k(t, \omega)$ denotes a current energy value for beam k and frequency band w at frame t, $E_k(t-1, \omega)$ denotes a previous energy value for beam k and frequency band w at frame t−1, denotes a time constant that controls how quickly the energy value estimate changes over time, and $x_k(t, \omega)$ denotes the subband sample at frame t of beam k.

The device 110 may determine the signal quality metric values $\Psi_k(t, \omega)$ using a first technique during playback conditions 420 (e.g., when the device 110 is outputting audio using the loudspeaker(s) 114) and using a second technique during non-playback conditions 430 (e.g., when the device 110 is not outputting audio using the loudspeaker(s) 114, which may be referred to as "non-playback conditions"). For example, when the device 110 is generating output audio during playback conditions 420, the device 110 may determine the signal quality metric values $\Psi_k(t, \omega)$ by comparing the energy values $E_k(t, \omega)$ to a noise floor (e.g., minimum energy value across all beams) using the playback SNR calculation 422, as shown below:

$$\Psi_k(t, \omega) = \frac{E_k(t, \omega)}{\min_k E_k(t, \omega)} \quad [2]$$

where $\Psi_k(t, \omega)$ denotes a signal quality metric value for beam k and frequency band ω, $E_k(t, \omega)$ denotes an energy value for beam k and frequency band ω, and $$\min_k E_k(t, \omega)$$

denotes a minimum energy value across all beams and represents a noise floor.

After detecting a wakeword represented in the input audio data, the device 110 may end playback and stop outputting the audio using the loudspeaker(s) 114, at which point the device 110 may determine the signal quality metric values $\Psi_k(t, \omega)$ as a ratio between fast-averaged energy values and slow-averaged energy values. For example, the device 110 may determine the fast-averaged energy values using a first time constant and determine the slow-averaged energy values using a second time constant that is much smaller than the first time constant, using non-playback SNR calculation 432 shown below:

$$\Psi_k(t, \omega) = \frac{E_k^{fast}(t, \omega)}{E_k^{slow}(t, \omega)} \quad [3]$$

where $\Psi_k(t, \omega)$ denotes a signal quality metric value for beam k and frequency band ω, $E_k^{fast}(t, \omega)$ denotes an energy value for beam k and frequency band ω determined using a first time constant (e.g., fast time constant), and $E_k^{slow}(t, \omega)$ denotes an energy value for beam k and frequency band w determined using a second time constant (e.g., slow time constant) that is smaller than the first time constant.

Figure 5A:
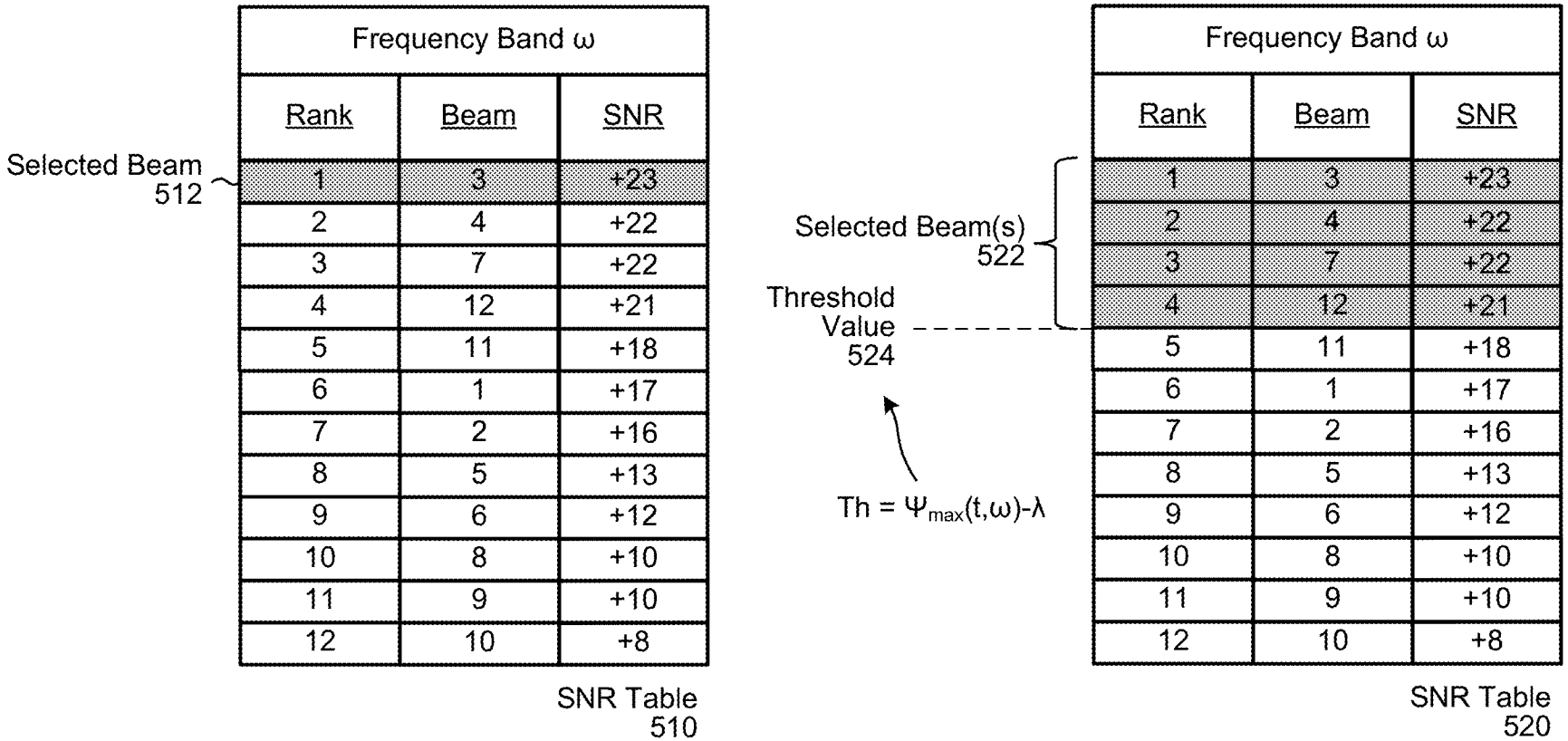
FIGS. 5A-5B illustrate examples of performing beam selection according to embodiments of the present disclosure.
Figure 5B:
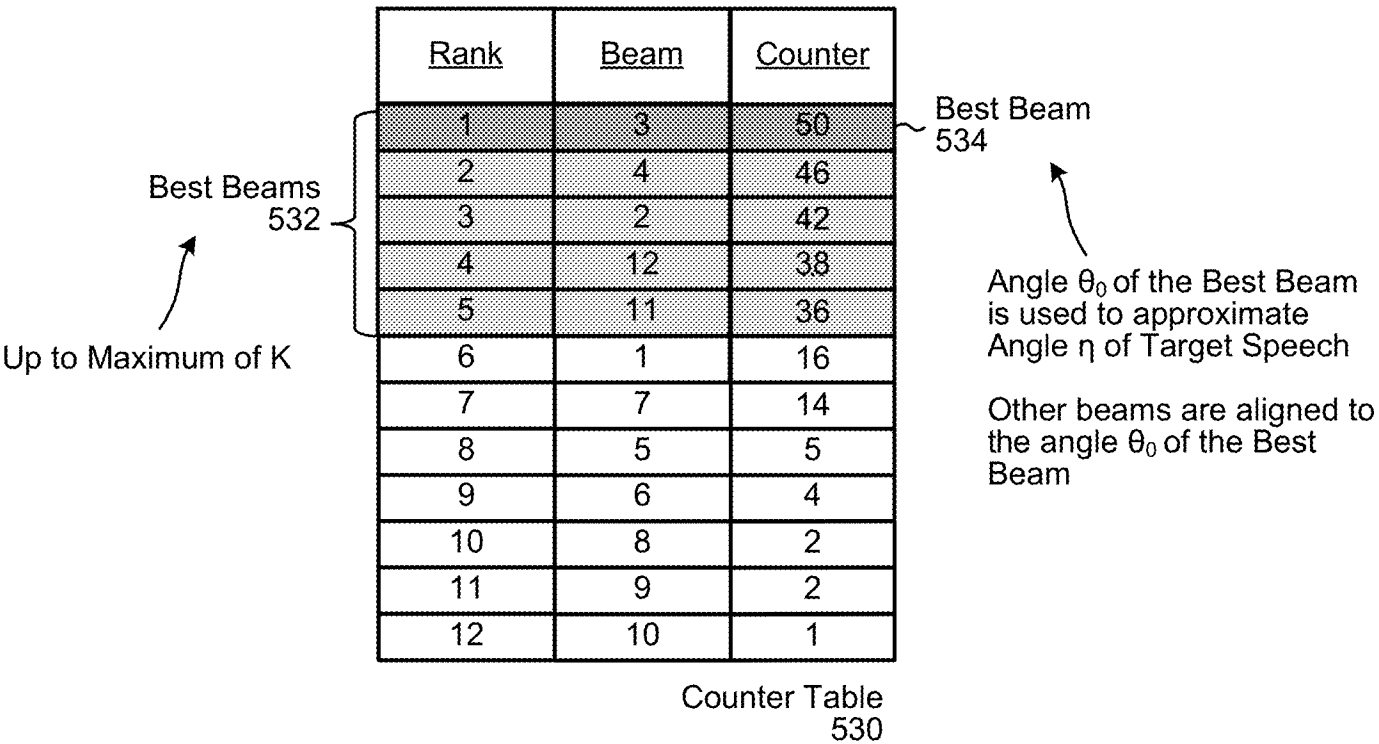

FIGS. 5A-5B illustrate examples of performing beam selection according to embodiments of the present disclosure. As illustrated in FIG. 5A, the device 110 may compare signal quality metric values (e.g., SNR values) at a particular frequency band w and select one or more of the highest SNR values.

In some examples, the device 110 may increment a counter value for a single beam that has a highest SNR value for the frequency band w. This is illustrated in FIG. 5A as SNR table 510, which shows all twelve beams ranked by SNR value, with a third beam having a highest SNR value (e.g., +23 dB). The device 110 may determine that the third beam has the highest SNR value of the twelve beams and select the third beam, incrementing a counter value for the selected beam 512. By repeating these steps for each frequency band ω, the device 110 may increment one of the twelve counter values a total of 256 times (e.g., for 256 frequency bands), and may select a first number of beams having the highest counter values (e.g., up to K best beams).

In other examples, the device 110 may increment counter value(s) for one or more beams for an individual frequency band ω based on a threshold value. This is illustrated in FIG. 5B as SNR table 520, which shows all twelve beams ranked by SNR value. Instead of selecting the highest SNR value as the selected beam 512 and incrementing a single counter value, the device 110 may identify the highest SNR value and determine a threshold value 524 using the highest SNR value. For example, the device 110 may determine the threshold value 524 by subtracting a fixed value $\lambda_{dB}$ (e.g., 3 dB) from the highest SNR value (e.g., $Th=\Psi_{max}(t, \omega)-\lambda_{dB}$). Additionally or alternatively, the device 110 may determine the threshold value 524 by multiplying the highest SNR value by a threshold parameter λ (e.g., $Th=\lambda\Psi_{max}(t, \omega)$) without departing from the disclosure. After determining the threshold value 524, the device 110 may identify which SNR values are higher than the threshold value 524 and may select one or more beams, represented as selected beams 522. The device 110 may then increment counter values corresponding to the selected beam(s) 522. Thus, the device 110 increments multiple counter values for a single frequency band, indicating that several beams had similarly high SNR values.

After incrementing the counter values using all of the frequency bands, the device 110 may select up to K best beams having a first number K (e.g., 4, 6, etc.) highest counter values. For example, the device 110 may sort the counter values in descending order, as illustrated in FIG. 5B as counter table 530, and may select beams corresponding to the first number K of highest counter values. In the example illustrated in FIG. 5B, the device 110 may select five beams as the best beams 532, although the disclosure is not limited thereto.

In addition, the device 110 may identify a best beam 534 and align the remaining beams of the best beams 532 to the best beam 534. For example, the device 110 may identify an angle $\theta_0$ of the best beam 534 and use this to approximate an angle η of target speech. Thus, the device 110 may align the remaining beams with the best beam 534 by phase matching, enabling the device 110 to generate distortionless output audio data.

Figure 6:
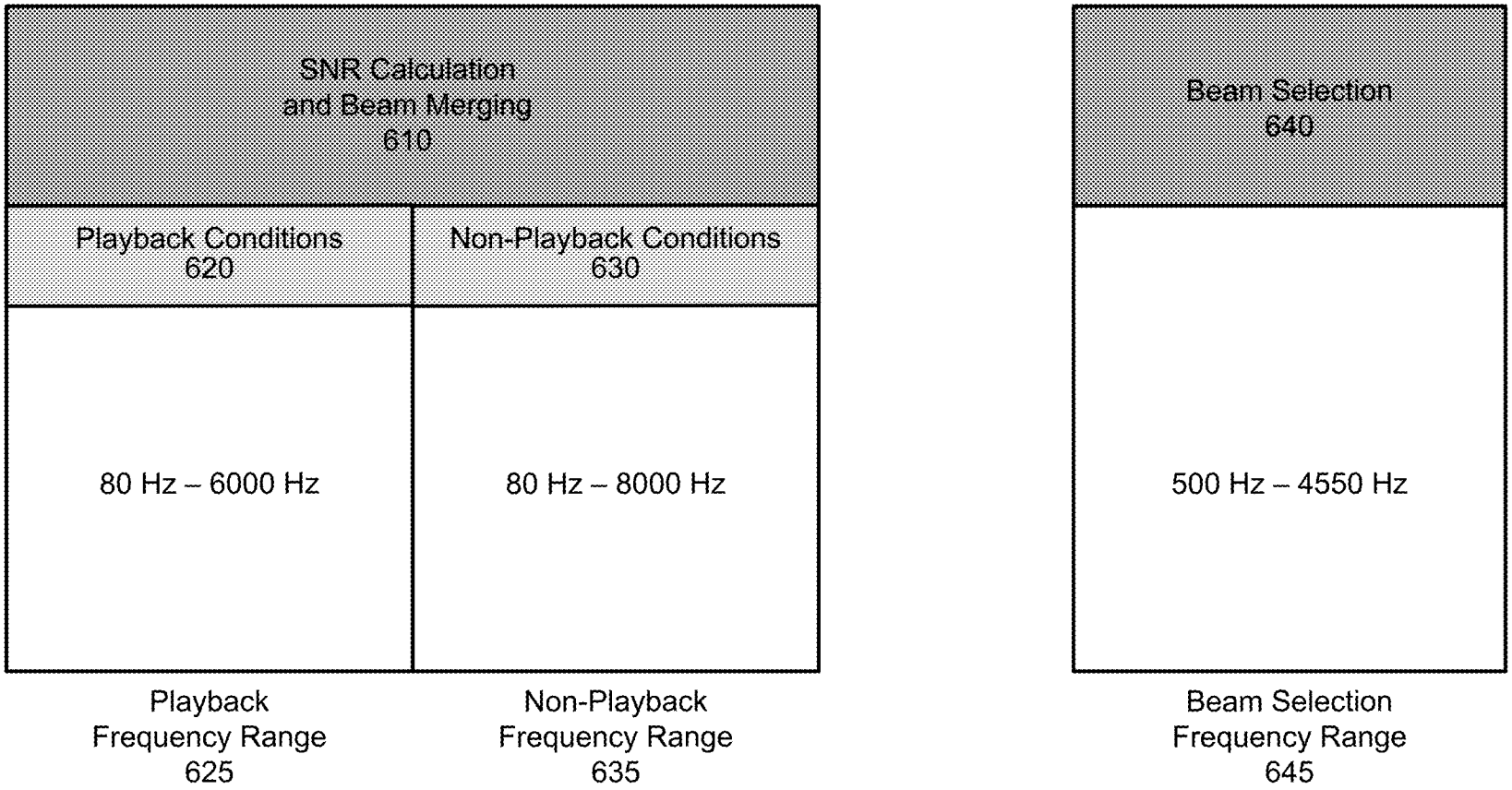
FIG. 6 illustrates examples of frequency ranges used at different times according to embodiments of the present disclosure.

FIG. 6 illustrates examples of frequency ranges used at different times according to embodiments of the present disclosure. As illustrated in FIG. 6, the device 110 may use different frequency ranges when analyzing and/or processing the audio data depending on the step being performed and current conditions. For example, when the device 110 is performing SNR calculation and/or beam merging 610, the device 110 may use a playback frequency range 625 (e.g., 80 Hz to 6,000 Hz) during playback conditions 620 or a non-playback frequency range 635 (e.g., 80 Hz to 8,000 Hz) during non-playback conditions 630. In contrast, when the device 110 is performing beam selection 640, the device 110 may use beam selection frequency range 645 (e.g., 500 Hz to 4,550 Hz). Thus, the frequencies of interest may change for different steps. While FIG. 6 illustrates an example by specifying the frequency ranges, the disclosure is not limited thereto and the actual frequency ranges used for each step may vary without departing from the disclosure.

FIG. 7 illustrates examples of calculating scaling values and phase values and performing aligned beam merging processing according to embodiments of the present disclosure. As illustrated in FIG. 7, the device 110 may determine scaling values α for each frequency band w for the best beams. For example, within each individual frequency band, the device 110 may compare a signal quality metric value associated with an individual beam of the best beams to a sum of all of the signal quality metric values for the best beams. Thus, the device 110 may calculate a scaling value 710 using the equation shown below:

$$\alpha_k(t, \omega) = \frac{\Psi_k(t, \omega)}{\sum_{l \in K} \Psi_l(t, \omega)} \forall k \in K \quad [4]$$

where $\alpha_k(t, \omega)$ denotes the scaling value for frequency band w and beam k during time t, $\Psi_k(t, \omega)$ denotes the signal quality metric for frequency band ω and beam k during time t, and $\Psi_l(t, \omega)$ denotes the signal quality metric for frequency band ω and beam l during time t, such that the device 110 computes a sum of signal quality metrics for the best beams.

The device 110 may also determine phase values β in each frequency band w for the best beams. For example, the device 110 may align each of the best beams with a single beam having the highest counter value of the best beams, as described above with regard to FIG. 5B. Thus, the device 110 may identify a best beam of the up to K best beams, identify an angle $\theta_0$ of the best beam, and use the angle $\theta_0$ to approximate an angle η of target speech. The device 110 may determine a phase value 720 using the equation shown below:

$$\beta_k(t,\omega)=\angle\{h_k^H(\omega)\cdot d(\omega,\theta_0) \quad [5]$$

where $\beta_k(t, \omega)$ denotes the phase value for frequency band ω and beam k during time t, $h_k^H(\omega)$ denotes the corresponding beamformer filter at frequency band ω and beam k, and $d(\omega, \theta_0)$ denotes a steering vector of the target speech at angle $\theta_0$.

The device 110 may generate output audio data using the scaling values α, the phase values β, and the beamformed audio data corresponding to the best beams. For example, the device 110 may generate output audio data using an aligned beam merger 730, shown below:

$$y(\omega)=\Sigma_k\alpha_k(\omega)e^{-j\beta_k\omega}y_k(\omega) \quad [6]$$

where $y(\omega)$ denotes output audio data after performing aligned beam merging, $\alpha_k(t, \omega)$ denotes the scaling value for frequency band ω and beam k, $\beta_k(t, \omega)$ denotes the phase value for frequency band ω and beam k, and $y_k(\omega)$ denotes the beamformed audio data for frequency band ω and beam k.

Figure 8:
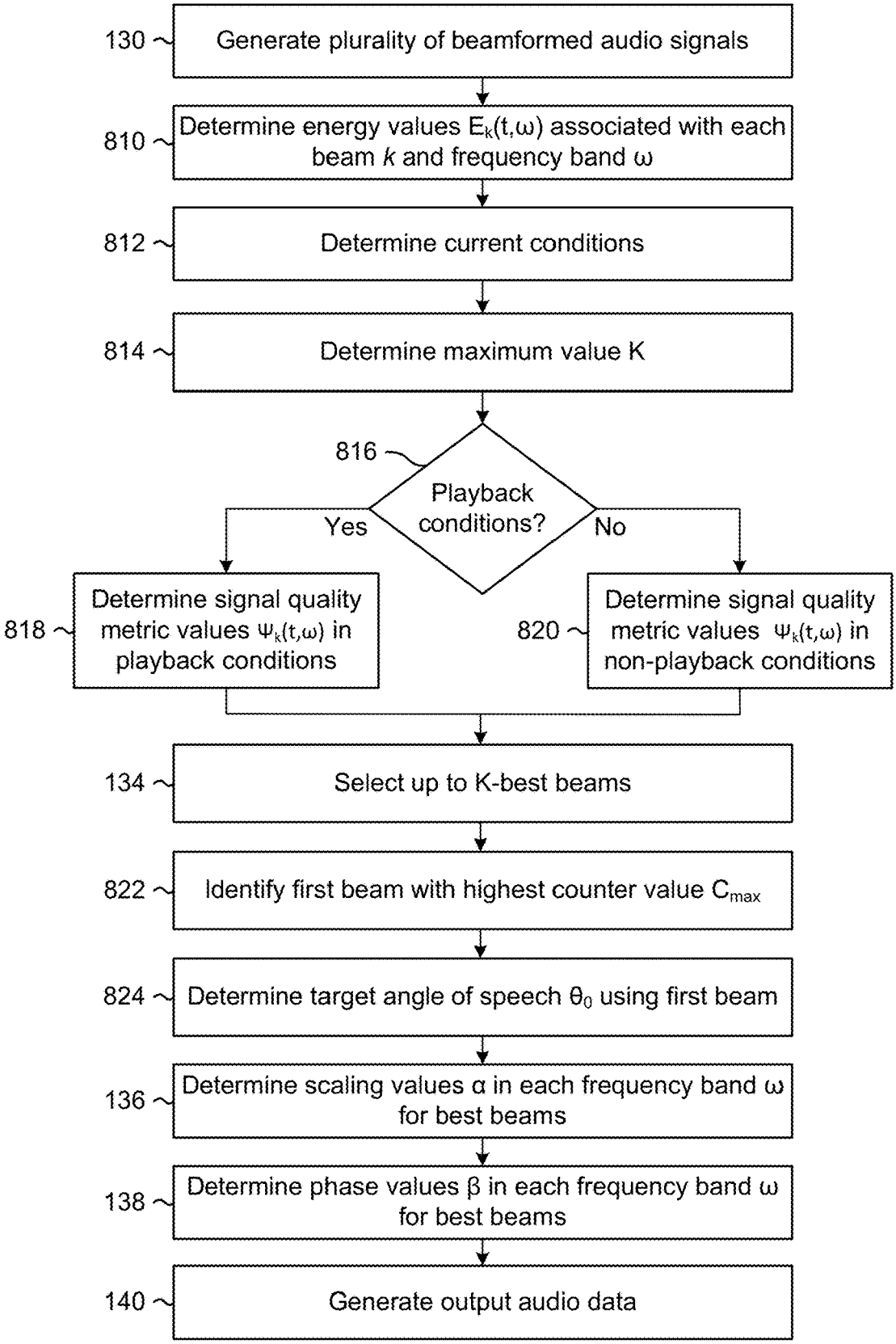
FIG. 8 is a flowchart conceptually illustrating an example method for performing aligned beam merging processing according to embodiments of the present disclosure.

FIG. 8 is a flowchart conceptually illustrating an example method for performing aligned beam merging processing according to embodiments of the present disclosure. As illustrated in FIG. 8, the device 110 may generate (130) a plurality of beamformed audio signals and determine (810) energy values $E_k(t, \omega)$ associated with each beam k and frequency band ω. For example, the device 110 may convert audio data from a time domain to a frequency domain using a first number (e.g., 256) of different frequency bands, and may generate beamformed audio signals in a second number of directions (e.g., 12 directions or 12 beams), resulting in a third number (e.g., 12×256=3072) of energy values $E_k(t, \omega)$. However, the disclosure is not limited thereto, and the first number of frequency bands and/or the second number of beams may vary without departing from the disclosure.

The device 110 may determine (812) current conditions and may determine (814) a maximum value K. The maximum value K indicates a maximum number of beams to be included when generating the output audio data. In some examples, the device 110 may determine the maximum value K based on the current conditions, although the disclosure is not limited thereto. For example, the device 110 may determine a reverberation of an environment of the device 110, selecting a larger number for K (e.g., K=6) when the environment is reverberant and a smaller number for K (e.g., K=4) when the environment is not reverberant. However, this is intended as an illustrative example and the disclosure is not limited thereto.

As used herein, the maximum value K indicates a maximum number of beams to select for each frequency band, but the device 110 may select fewer beams than the maximum value K without departing from the disclosure. Thus, the device 110 may select up to K beams for each individual frequency band, based on signal quality metric values and/or the like. In some examples, the number of maximum value K may be dynamic, such that the device 110 determines the maximum value K periodically based on signal conditions, although the disclosure is not limited thereto.

Based on the current conditions, the device 110 may determine (816) whether playback conditions or non-playback conditions are present. If playback conditions are present, the device 110 may determine (818) signal quality metric values in the playback conditions, as described above with regard to playback SNR calculation 422 in FIG. 4. If non-playback conditions are present, the device 110 may determine (820) signal quality metric values in the non-playback conditions, as described above with regard to non-playback SNR calculation 432 in FIG. 4.

The device 110 may then select (134) up to K best beams based on the signal quality metric values. For example, the device 110 may increment counter values for individual beams when a corresponding signal quality metric value exceeds a threshold, as described in greater detail above. The device 110 may then select a first number of beams (e.g., best beams) associated with the K (e.g., 4, 6, etc.) highest counter values. Using the counter values, the device 110 may identify (822) a first beam with a highest counter value (e.g., best beam) and may determine (824) a target angle of speech using the first beam. For example, the device 110 may determine a first angle of the first beam and may approximate the target angle of speech using the first angle of the first beam.

The device 110 may determine (136) scaling values $\alpha$ for each frequency band w for the best beams. For example, within each individual frequency band, the device 110 may compare a signal quality metric value associated with an individual beam of the best beams to a sum of all of the signal quality metric values for the best beams. Thus, the device 110 may take a scalar ratio for each of the best beams and use the scaling value to generate a weighted sum.

The device 110 may also determine (138) phase values $\beta$ in each frequency band $\omega$ for the best beams. For example, the device 110 may align each of the best beams with a single beam having the highest counter value of the best beams. The device 110 may generate (140) output audio data using the scaling values $\alpha$, the phase values $\beta$, and the beamformed audio data corresponding to the best beams.

Figure 9A:
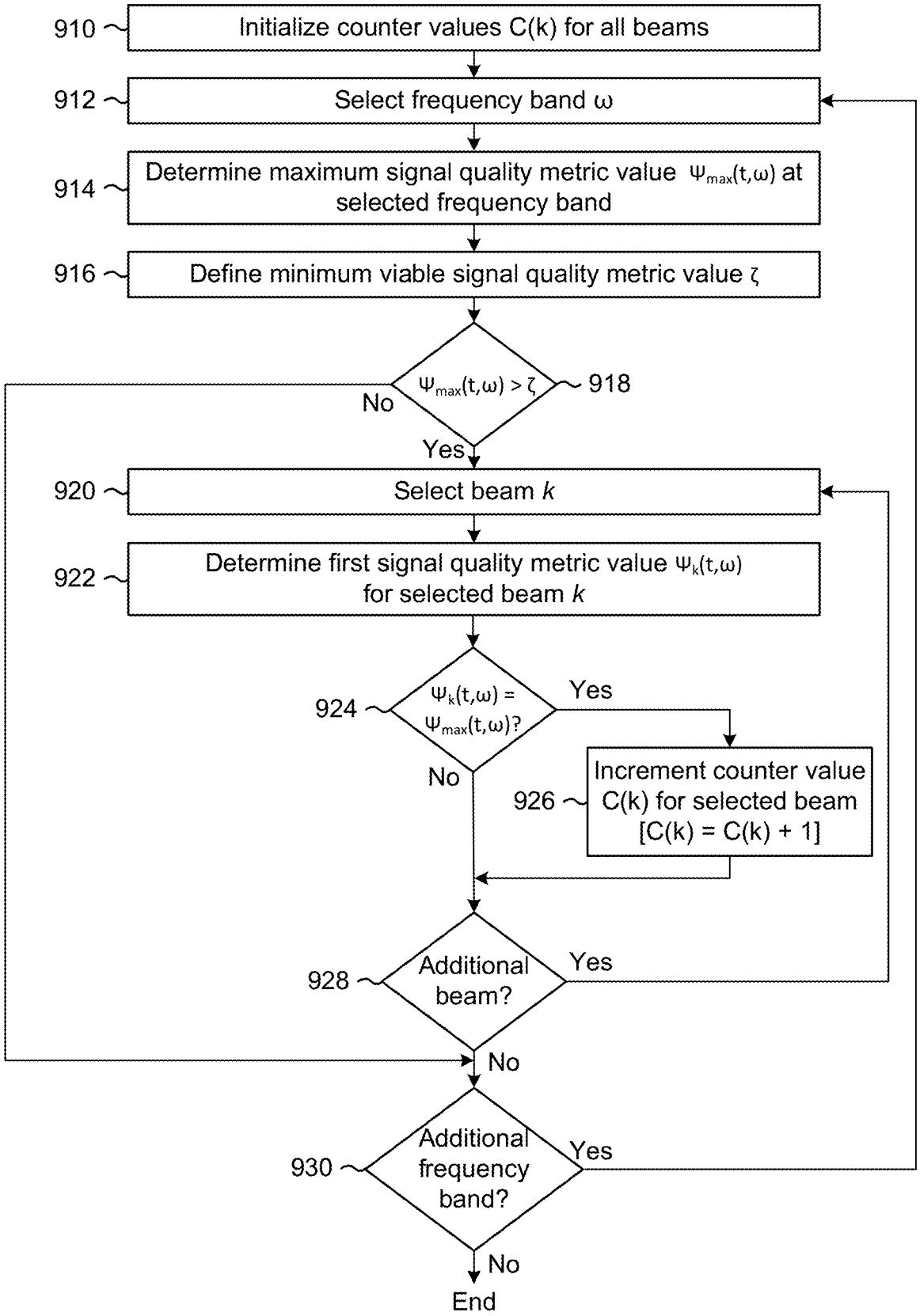
FIGS. 9A-9B are flowcharts conceptually illustrating example methods for increasing counter values according to embodiments of the present disclosure.
Figure 9B:
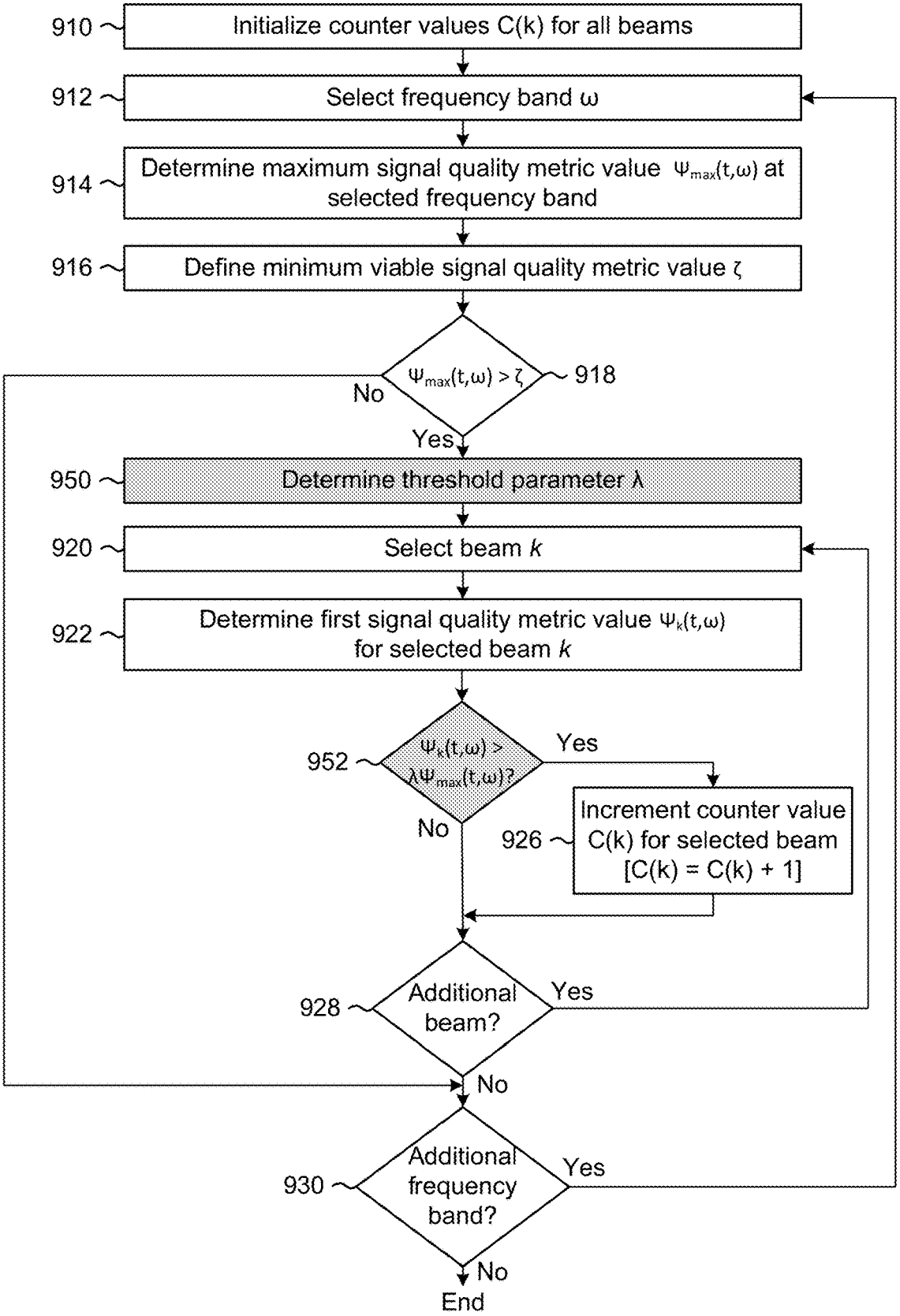

FIGS. 9A-9B are flowcharts conceptually illustrating example methods for increasing counter values according to embodiments of the present disclosure. As illustrated in FIG. 9A, the device 110 may initialize (910) counter values C(k) for all beams. In some examples, the device 110 may initialize the counter values to a value of zero, such that there is no history of previous values. However, the disclosure is not limited thereto, and in other examples the device 110 may take into account a previous counter value associated with a previous audio frame when initializing the counter value for a current audio frame without departing from the disclosure.

The device 110 may select (912) a frequency band $\omega$ from a plurality of frequency bands and may determine (914) a maximum signal quality metric value $\Psi_{max}(t, \omega)$ for all of the beams at the selected frequency band. For example, the device 110 may calculate the signal quality metric values for every beam (e.g., 12 beams, although the disclosure is not limited thereto) and select the highest signal quality metric value. The device 110 may define (916) a minimum viable signal quality metric value corresponding to a lowest signal quality metric value that is distinguishable from a noise floor (e.g., 10 dB), and may determine (918) whether the maximum signal quality metric value $\Psi_{max}(t, \omega)$ exceeds the minimum viable signal quality metric value $\zeta$. If the maximum signal quality metric value does not exceed the minimum viable signal quality metric value the device 110 may loop to step 930 and skip the frequency band entirely as all of the beams are dominated by noise (e.g., do not rise above the noise floor enough to use to increment counter values).

If the maximum signal quality metric does exceed the minimum viable signal quality metric value $\zeta$, the device 110 may select (920) beam k, determine (922) a first signal quality metric value $\Psi_k(t, \omega)$ for the selected beam, and determine (924) whether the first signal quality metric value $\Psi_k(t, \omega)$ is equal to the maximum signal quality metric value $\Psi_{max}(t, \omega)$. If the first signal quality metric value $\Psi_k(t, \omega)$ is equal to the maximum signal quality metric value $\Psi_{max}(t, \omega)$, the device 110 may increment (926) a counter value C(k) for the selected beam (e.g., C(k)=C(k)+1). If the first signal quality metric value $\Psi_k(t, \omega)$ is not equal to the maximum signal quality metric value $\Psi_{max}(t, \omega)$, the device 110 may not increment the counter value.

While FIG. 9A illustrates step 922 as determining the first signal quality metric value, the device 110 may have previously calculated the first signal quality metric value and step 922 may refer to identifying that the first signal quality metric value corresponds to the selected beam. For example, the device 110 may calculate all of the signal quality metric values for the plurality of beams associated with the selected frequency band in step 914 as part of determining the maximum signal quality metric value, although the disclosure is not limited thereto.

The device 110 may then determine (928) whether there is an additional beam to process for the selected frequency band and, if so, may loop to step 920 to select the additional beam. If there is not an additional beam to process, the device 110 may determine (930) whether there is an additional frequency band to process, and if so, may loop to step 912 to select the additional frequency band. Thus, FIG. 9A illustrates an example method of incrementing a counter value only for the beams that have the highest signal quality metric value.

In some examples, the device 110 may increment counter values for multiple beams associated with a single frequency band without departing from the disclosure. As illustrated in FIG. 9B, prior to selecting beam k in step 920, the device 110 may determine (950) a threshold parameter $\lambda$ that may be used to determine a threshold value. Thus, after determining the first signal quality metric value in step 922, the device 110 may determine (952) whether the first signal quality metric value exceeds a threshold value (e.g., $\Psi_k(t, \omega) > \lambda\Psi_{max}(t, \omega)$, where $\lambda\Psi_{max}(t, \omega)$ corresponds to the threshold value). If the first signal quality metric value exceeds the threshold value, the device 110 may increment (926) the counter value C(k) for the selected beam as described above with regard to FIG. 9A. Thus, the device 110 may increment counter values for any signal quality metric value that is higher than the threshold value, regardless of a number of signal quality metric values that satisfy this condition.

To illustrate an example, the threshold parameter $\lambda$ may be a value between zero and 1 (e.g., $0<\lambda\leq 1$), such that the threshold value is a portion of the maximum signal quality metric value. In some examples, the threshold parameter $\lambda$ may be equal to a value of 0.5, representing that the threshold value is half of the magnitude of the maximum signal quality metric value. However, the disclosure is not limited thereto, and in some examples the threshold parameter may be represented using decibels (dB) without departing from the disclosure. For example, the device 110 may determine the threshold value by subtracting 3 dB from the maximum signal quality metric value without departing from the disclosure.

Figure 10:
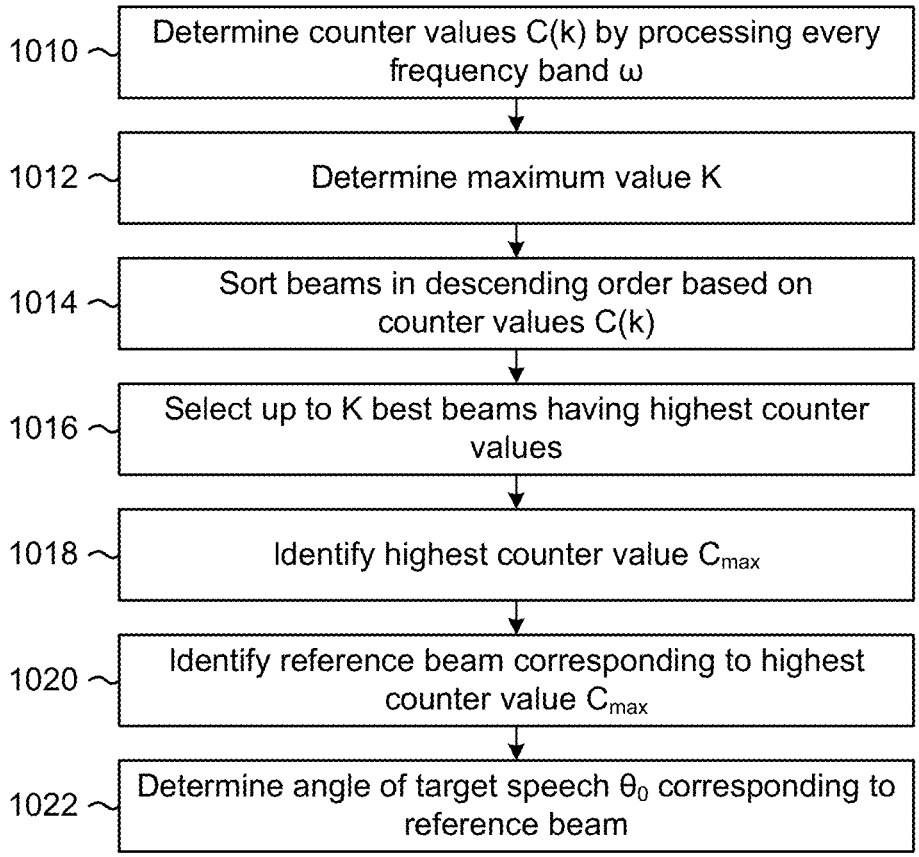
FIG. 10 is a flowchart conceptually illustrating an example method for selecting beams according to embodiments of the present disclosure.

FIG. 10 is a flowchart conceptually illustrating an example method for selecting beams according to embodiments of the present disclosure. As illustrated in FIG. 10, the device 110 may determine (1010) counter values C(k) by processing every frequency band $\omega$, as described above with regard to FIGS. 9A-9B. The device 110 may determine (1012) a maximum value K. The maximum value K indicates a maximum number of beams to be included when generating the output audio data. In some examples, the device 110 may determine the maximum value K based on the current signal conditions, although the disclosure is not limited thereto. For example, the device 110 may determine a reverberation of an environment of the device 110, selecting a larger number for K (e.g., K=6) when the environment is reverberant and a smaller number for K (e.g., K=4) when the environment is not reverberant. However, this is intended as an illustrative example and the disclosure is not limited thereto.

As used herein, the maximum value K indicates a maximum number of beams to select for each frequency band, but the device 110 may select fewer beams than the maximum value K without departing from the disclosure. Thus, the device 110 may select up to K beams for each individual frequency band, based on signal quality metric values and/or the like. In some examples, the number of maximum value K may be dynamic, such that the device 110 determines the maximum value K periodically based on signal conditions, although the disclosure is not limited thereto.

The device 110 may then sort (1014) the beams in descending order based on the counter values C(k) and may select (1016) up to K best beams having the highest counter values. For example, the device 110 may select the K (e.g., six) highest counter values and determine the best beams that correspond to these six counter values. In some examples, the device 110 may select six (e.g., K=6) beams out of twelve total beams (e.g., B=12), although the disclosure is not limited thereto and both the number of beams and the number of best beams may vary without departing from the disclosure. Thus, the device 110 may generate any number of beams and select any portion of the total beams without departing from the disclosure.

The device 110 may identify (1018) a highest counter value $C_{max}$, may identify (1020) a reference beam corresponding to the highest counter value, and may determine (1022) an angle of target speech $\theta_0$ corresponding to the reference beam. For example, the device 110 may determine the angle of the reference beam (e.g., $\theta_0$) and use this angle to approximate the angle of target speech $\eta$.

Figure 11:
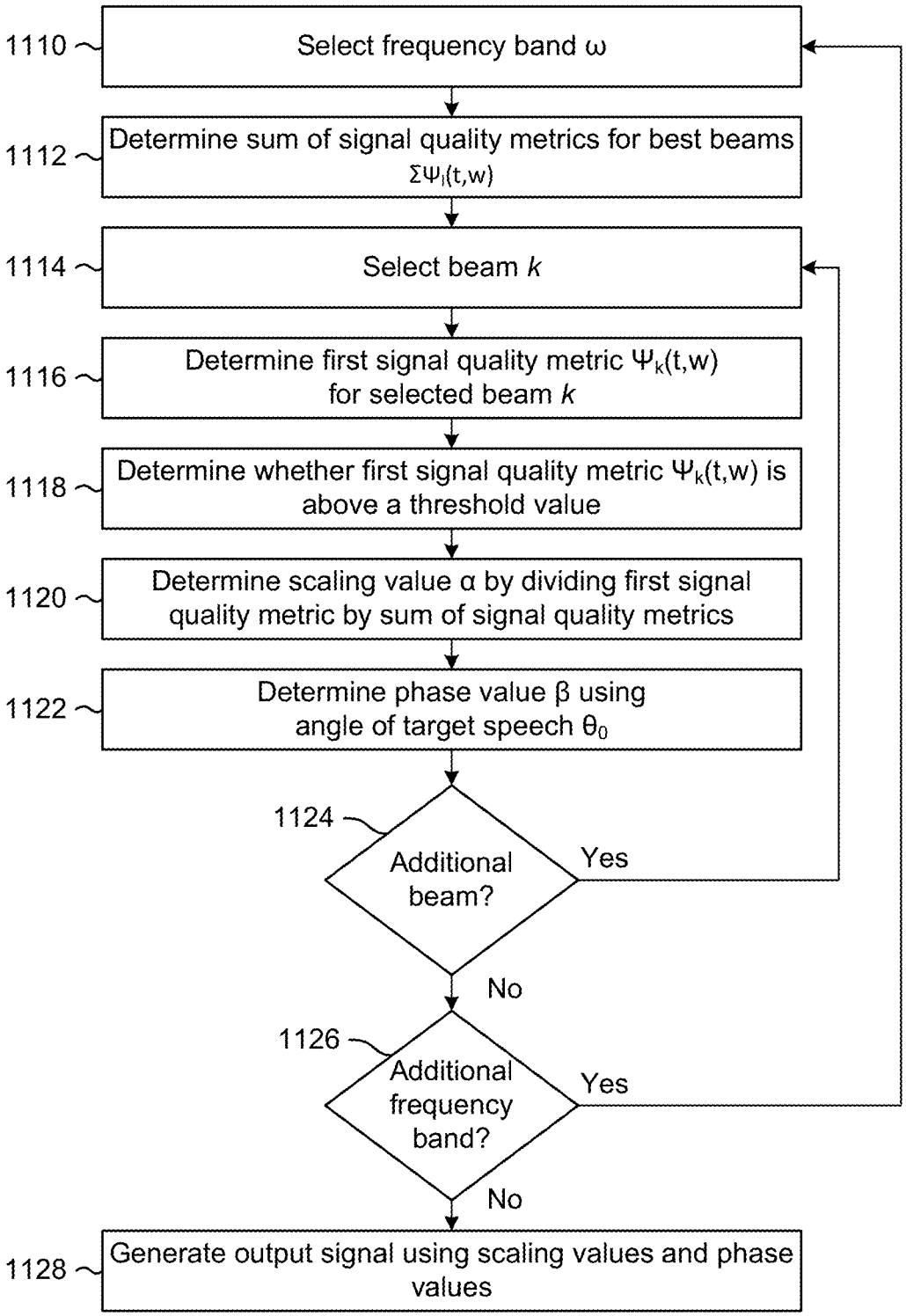
FIG. 11 is a flowchart conceptually illustrating an example method for calculating scaling values and phase values and generating an output audio signal according to embodiments of the present disclosure.

FIG. 11 is a flowchart conceptually illustrating an example method for calculating scaling values and phase values and generating an output audio signal according to embodiments of the present disclosure. As illustrated in FIG. 11, the device 110 may select (1110) frequency band $\omega$ and may determine (1112) a sum of signal quality metrics for the best beams (e.g., $\Sigma\Psi_l(t,w)$), as described above with regard to scaling value 710 illustrated in FIG. 7. Note that the sum of signal quality metrics for the best beams only includes the signal quality metrics that exceed a threshold value, as described in greater detail below with regard to step 1118.

The device 110 may then select (1114) beam k, determine (1116) a first signal quality metric $\Psi_k(t, \omega)$ for selected beam k, and may determine (1118) whether the first signal quality metric $\Psi_k(t, \omega)$ is above a threshold value. In some examples, the device 110 may compare each of the best beams to the reference beam for each frequency band $\omega$. For example, the device 110 may identify the reference beam (e.g., beam corresponding to the highest counter value, as described above with regard to steps 1018-1020) and use a reference signal quality metric associated with the reference beam within the selected frequency band $\omega$ to determine the threshold value.

To illustrate an example, the device 110 may identify the reference signal quality metric for the selected frequency band $\omega$ and determine the threshold value by subtracting a fixed value (e.g., 3 dB) from the reference signal quality metric or multiplying the reference signal quality metric by a fixed percentage (e.g., 50%). If the first signal quality metric for the selected beam k is below the threshold value, the device 110 removes the selected beam k from the best beams for the selected frequency band $\omega$. If the first signal quality metric for the selected beam k is above the threshold value, the device 110 continues processing as normal. Thus, while each of the best beams have high signal quality metric values globally, this removes portions of the best beams that have low signal quality metric values within individual frequency bands. As a result of step 1118, the device 110 only selects up to K best beams within each frequency band $\omega$, with K indicating a maximum number of beams if every beam is above the threshold value.

The device 110 may determine (1120) a scaling value $\alpha_k$ for the selected beam k and the selected frequency band $\omega$. For example, when the first signal quality metric is above the threshold value in step 1118, the device 110 may determine the scaling value $\alpha_k$ by dividing the first signal quality metric by the sum of signal quality metrics determined above in step 1112 (e.g., after removing any signal quality metrics that are below the threshold value in step 1118). In contrast, when the first signal quality metric is below the threshold value in step 1118, the device 110 may set the scaling value $\alpha_k$ equal to a value of zero (e.g., $\alpha_k=0$), reflecting that the selected beam k is not included in the best beams for the selected frequency band $\omega$.

The device 110 may also determine (1122) a phase value $\beta_k$ using the angle of the target speech $\theta_0$, as described above with regard to phase value 720 illustrated in FIG. 7. In some examples, the device 110 may precalculate or precompute all potential complex correction factors between the angle of each beam $\theta_k$ and the angle of the best beam $\theta_0$. For example, the device 110 may store a lookup table of complex correction factors that indicate a correction factor (e.g., phase component, phase value, etc.) for each individual beam angle $\theta_k$ relative to any potential best beam $\theta_0$ (e.g., each beam is associated with a particular beam angle $\theta_k$ and a plurality of correction factors between the beam angle $\theta_k$ and the remaining beam angles). Thus, the device 110 may select the best beam angle $\theta_0$ and retrieve complex correction factors (e.g., phase values) for the other best beams based on the best beam angle $\theta_0$.

The device 110 may determine (1124) whether there is an additional beam to process for the selected frequency band, and if so, may loop to step 1114 to process the additional beam. If not, the device 110 may determine (1126) whether there is an additional frequency band, and if so, may loop to step 1110 to process the additional frequency band. If not, the device 110 may generate (1128) an output signal (e.g., output audio data) using the scaling values and the phase values associated with the best beams, as described above with regard to the aligned beam merger 730 illustrated in FIG. 7. For example, the device 110 may apply the individual scaling value and phase value for each frequency band of the best beams to generate a portion of the output signal and then combine the portions of the output signal to generate the output audio data.

Figure 12A:
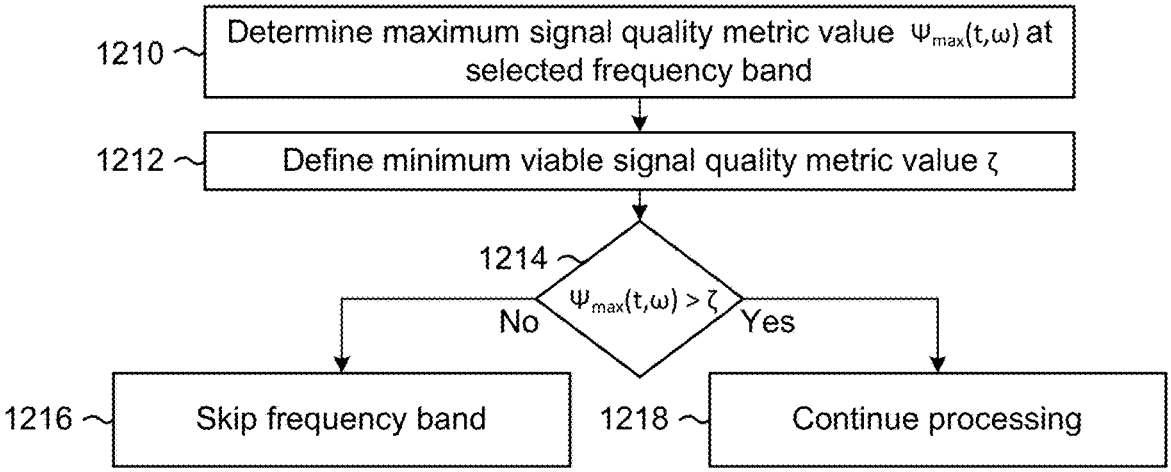
FIGS. 12A-12D are flowcharts conceptually illustrating example methods for variations to aligned beam merging processing according to embodiments of the present disclosure.
Figure 12B:
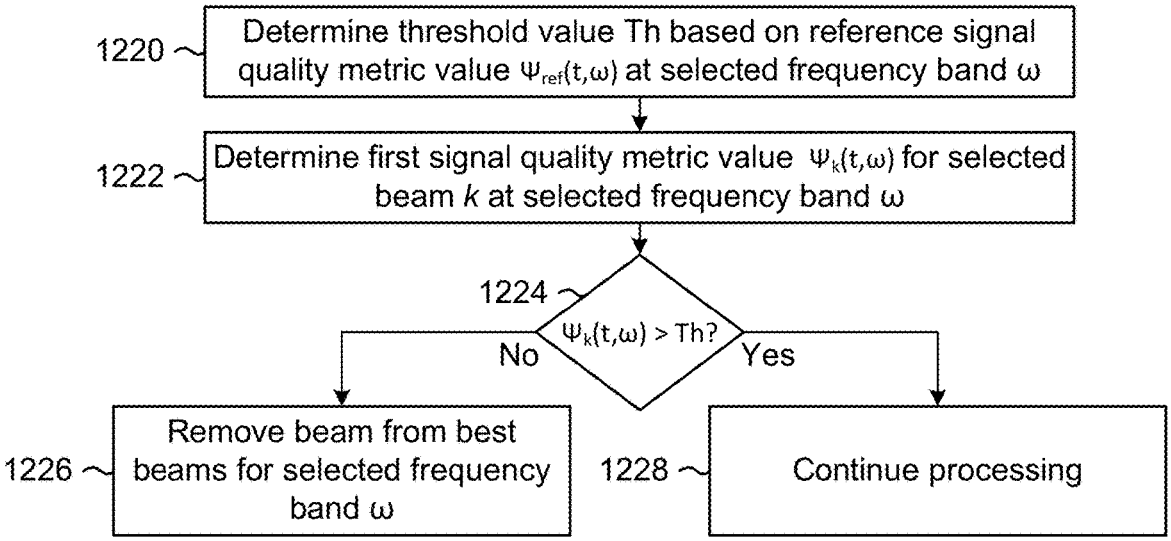
Figure 12C:
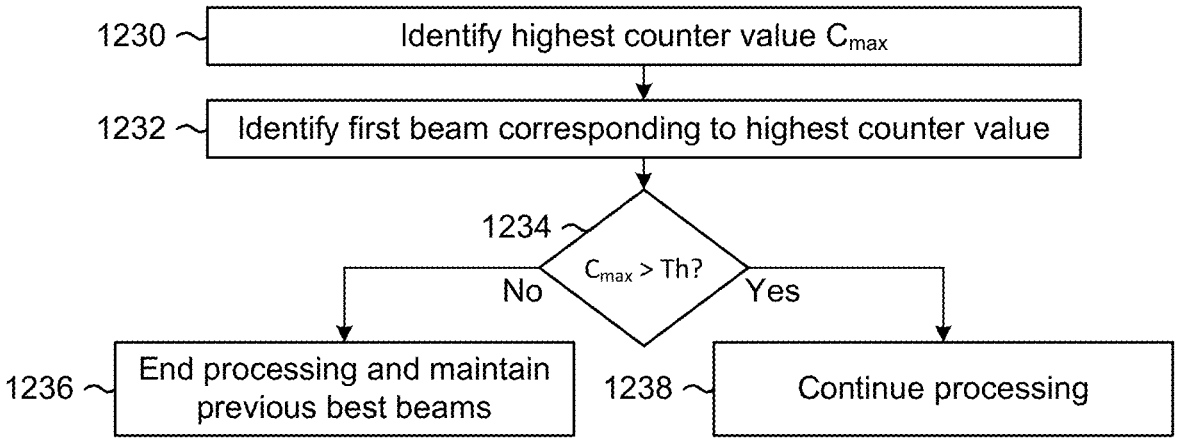
Figure 12D:
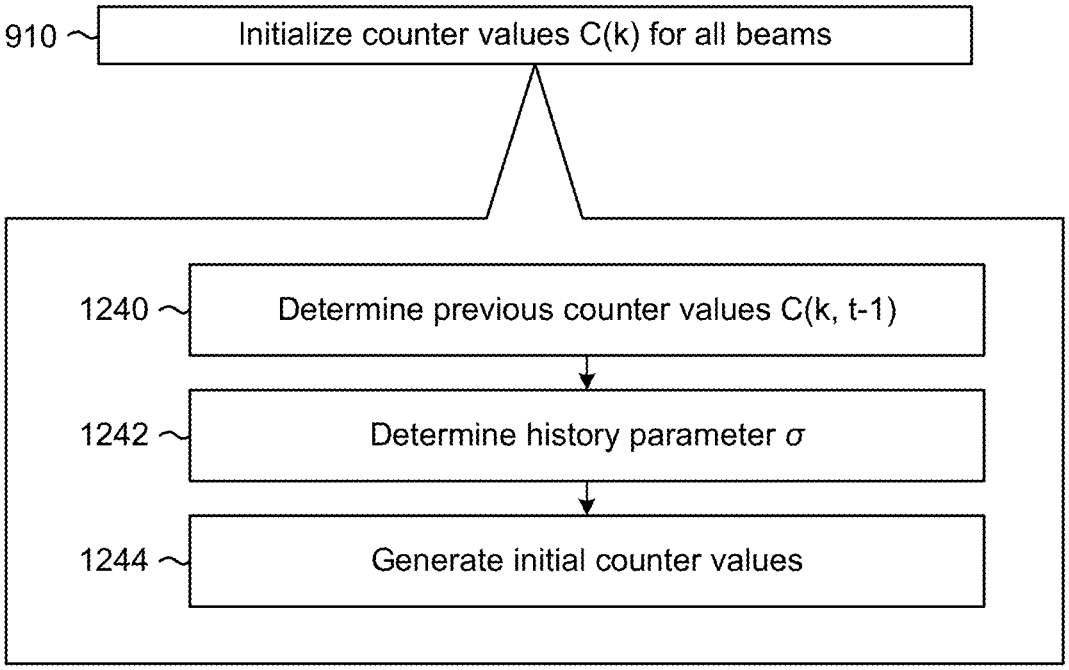

FIGS. 12A-12D are flowcharts conceptually illustrating example methods for variations to aligned beam merging processing according to embodiments of the present disclosure. As illustrated in FIG. 12A-12D, the device 110 may vary the aligned beam merger algorithm in multiple ways to improve an output of the output audio data generated by performing aligned beam merger processing. For example, the device 110 may skip frequency bands that do not rise above a noise floor (e.g., minimum viable signal quality metric value) s illustrated in FIG. 12A, may select fewer than K beams when a counter value is below a threshold as illustrated in FIG. 12B, may select a single beam without performing aligned beam merger processing when the highest counter value is below a threshold as illustrated in FIG. 12C, and/or may initialize counter values C(k) based on previous audio frames as illustrated in FIG. 12D.

As illustrated in FIG. 12A, the device 110 may determine (1210) a maximum signal quality metric value $\Psi_{max}(t, \omega)$ at the selected frequency band, may define (1212) a minimum viable signal quality metric value $\zeta$, and determine (1214) whether the maximum signal quality metric value exceeds the minimum viable signal quality metric value. If the maximum signal quality metric value does not exceed the minimum viable signal quality metric value, the device 110 may skip (1216) the frequency band and not increment counter values, but if the maximum signal quality metric value exceeds the minimum viable signal quality metric value, the device 110 may continue (1218) processing. Thus, the device 110 may skip a frequency band that is not significantly higher than a noise floor without departing from the disclosure, although the disclosure is not limited thereto.

As illustrated in FIG. 12B, the device 110 may determine (1220) a threshold value Th based on a reference signal quality metric value $\Psi_{ref}(t, \omega)$ at the selected frequency band $\omega$, may determine (1222) a first signal quality metric value $\Psi_k(t, \omega)$ for a selected beam k at the selected frequency band $\omega$, and may determine (1224) whether the first signal quality metric $\Psi_k(t, \omega)$ exceeds the threshold value (e.g., $\Psi_k(t, \omega)>Th$), as described above with regard to step 1118. If the first signal quality metric $\Psi_k(t, \omega)$ does not exceed the threshold value, the device 110 may remove (1226) the selected beam k from the best beams for the selected frequency band $\omega$, whereas if the first signal quality metric $\Psi_k(t, \omega)$ does exceed the threshold value, the device 110 may continue (1228) processing. Thus, the device 110 may select fewer than a fixed value K of the best beams if a first signal quality metric $\Psi_k(t, \omega)$ is below the threshold value, such that the device 110 performs align beam merger processing using fewer than K beams, without departing from the disclosure.

As illustrated in FIG. 12C, the device 110 may identify (1230) a highest counter value $C_{max}$, identify (1232) a first beam corresponding to the highest counter value, and determine (1234) whether the highest counter value exceeds a threshold value (e.g., $C_{max}>Th$). If the highest counter value does not exceed the threshold value, the device 110 may end (1236) processing and maintain the previously selected best beams when performing beam merging (e.g., aligned beam merger processing), whereas if the highest counter value does exceed the threshold value, the device 110 may continue (1238) processing. Thus, when the highest counter value is below the threshold value, the device 110 may maintain a previous selection without updating the best beams.

As illustrated in FIG. 12D, the device 110 may initialize the counter values C(k) for all beams in step 910 based on previous counter values, such that the device 110 incorporates history when selecting the best beams. For example, the device 110 may determine (1240) previous counter values C(k, t−1) for a particular beam (e.g., counter value for a previous audio frame), may determine (1242) a history parameter $\sigma$, and may generate (1244) initial counter values C(k, t) for the current audio frame based on the history parameter $\sigma$.

In some examples, the device 110 may initialize the counter values C(k) to a fixed value for the previous best beams. For example, the device 110 may set the history parameter $\sigma$ to a fixed value and generate the initial counter values such that the best beams are initialized using the history parameter $\sigma$ (e.g., $C(k)=\sigma$ for best beams) and the remaining beams are initialized to a value of zero (e.g., C(k)=0 for non-best beams). This provides an advantage to the previous best beams, which may reduce fluctuations and variations in which beams are selected as the best beams.

In other examples, the device 110 may initialize the counter values C(k) dynamically based on the previous counter values C(k−1). For example, the device 110 may set the history parameter $\sigma$ to a value between zero and one (e.g., $0<\sigma\leq 1$) and may multiply the history parameter $\sigma$ by the previous counter values C(k, t−1) to generate the initial counter values C(k, t) (e.g., $C(k, t)=\sigma C(k, t-1)$), although the disclosure is not limited thereto.

Figure 13:
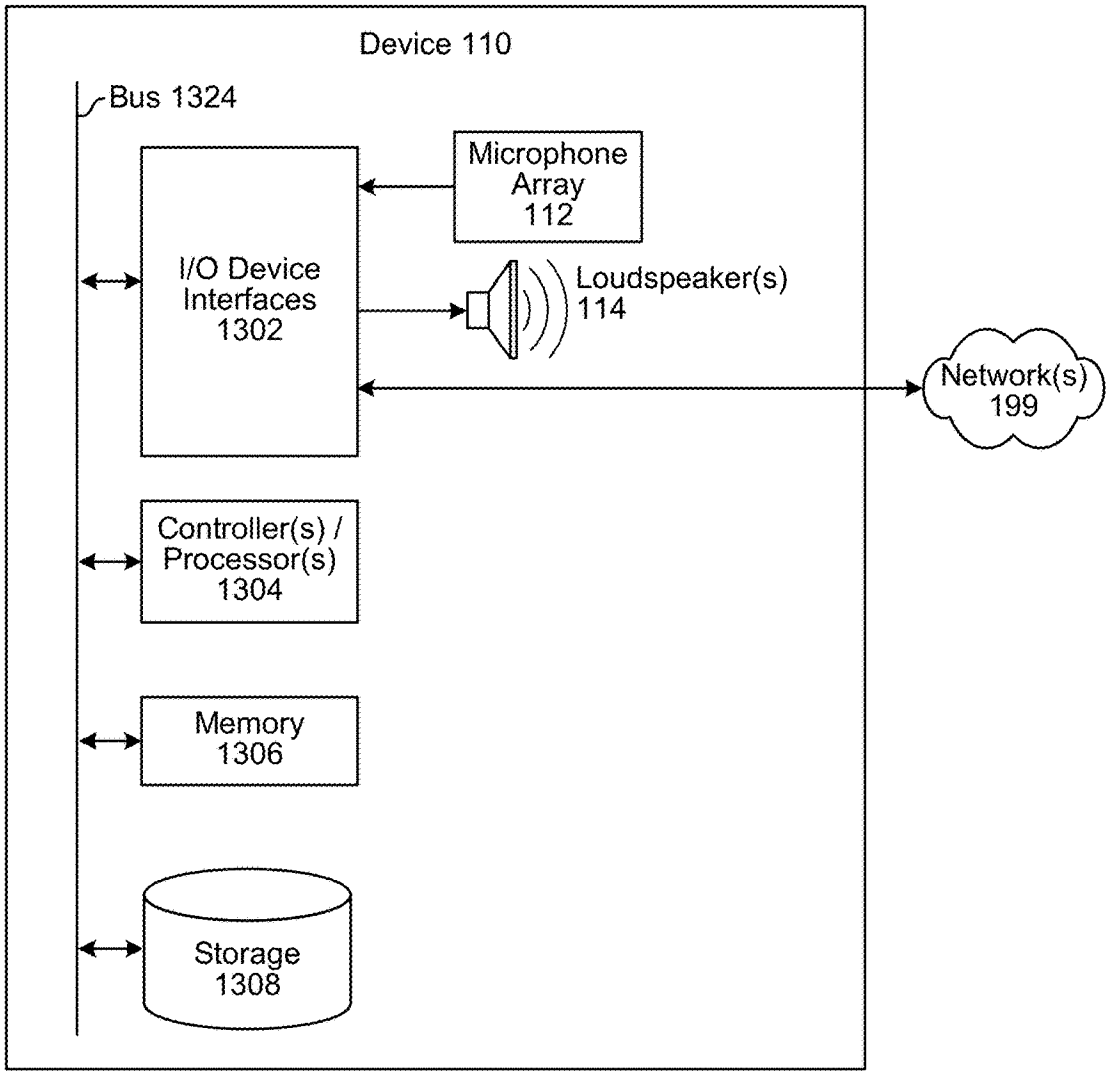
FIG. 13 is a block diagram conceptually illustrating example components of a system according to embodiments of the present disclosure.

FIG. 13 is a block diagram conceptually illustrating example components of a system \ according to embodiments of the present disclosure. In operation, the system 100 may include computer-readable and computer-executable instructions that reside on the device 110, as will be discussed further below.

The device 110 may include one or more audio capture device(s), such as a microphone array which may include one or more microphones 112. The audio capture device(s) may be integrated into a single device or may be separate. The device 110 may also include an audio output device for producing sound, such as loudspeaker(s) 116. The audio output device may be integrated into a single device or may be separate.

As illustrated in FIG. 13, the device 110 may include an address/data bus 1324 for conveying data among components of the device 110. Each component within the device 110 may also be directly connected to other components in addition to (or instead of) being connected to other components across the bus 1324.

The device 110 may include one or more controllers/processors 1304, which may each include a central processing unit (CPU) for processing data and computer-readable instructions, and a memory 1306 for storing data and instructions. The memory 1306 may include volatile random access memory (RAM), non-volatile read only memory (ROM), non-volatile magnetoresistive (MRAM) and/or other types of memory. The device 110 may also include a data storage component 1308, for storing data and controller/processor-executable instructions (e.g., instructions to perform operations discussed herein). The data storage component 1308 may include one or more non-volatile storage types such as magnetic storage, optical storage, solid-state storage, etc. The device 110 may also be connected to removable or external non-volatile memory and/or storage (such as a removable memory card, memory key drive, networked storage, etc.) through the input/output device interfaces 1302.

The device 110 includes input/output device interfaces 1302. A variety of components may be connected through the input/output device interfaces 1302. For example, the device 110 may include one or more microphone(s) 112 (e.g., a plurality of microphones 112 in a microphone array), one or more loudspeaker(s) 114, and/or a media source such as a digital media player (not illustrated) that connect through the input/output device interfaces 1302, although the disclosure is not limited thereto. Instead, the number of microphones 112 and/or the number of loudspeaker(s) 114 may vary without departing from the disclosure. In some examples, the microphones 112 and/or loudspeaker(s) 114 may be external to the device 110, although the disclosure is not limited thereto. The input/output interfaces 1302 may include A/D converters (not illustrated) and/or D/A converters (not illustrated).

The input/output device interfaces 1302 may also include an interface for an external peripheral device connection such as universal serial bus (USB), FireWire, Thunderbolt, Ethernet port or other connection protocol that may connect to network(s) 199.

The input/output device interfaces 1302 may be configured to operate with network(s) 199, for example via an Ethernet port, a wireless local area network (WLAN) (such as WiFi), Bluetooth, ZigBee and/or wireless networks, such as a Long Term Evolution (LTE) network, WiMAX network, 3G network, etc. The network(s) 199 may include a local or private network or may include a wide network such as the internet. Devices may be connected to the network(s) 199 through either wired or wireless connections.

The device 110 may include components that may comprise processor-executable instructions stored in storage 1308 to be executed by controller(s)/processor(s) 1304 (e.g., software, firmware, hardware, or some combination thereof). For example, components of the device 110 may be part of a software application running in the foreground and/or background on the device 110. Some or all of the controllers/components of the device 110 may be executable instructions that may be embedded in hardware or firmware in addition to, or instead of, software. In one embodiment, the device 110 may operate using an Android operating system (such as Android 4.3 Jelly Bean, Android 4.4 KitKat or the like), an Amazon operating system (such as FireOS or the like), or any other suitable operating system.

Computer instructions for operating the device 110 and its various components may be executed by the controller(s)/processor(s) 1304, using the memory 1306 as temporary "working" storage at runtime. The computer instructions may be stored in a non-transitory manner in non-volatile memory 1306, storage 1308, or an external device. Alternatively, some or all of the executable instructions may be embedded in hardware or firmware in addition to or instead of software.

Multiple devices may be employed in a single device 110. In such a multi-device device, each of the devices may include different components for performing different aspects of the processes discussed above. The multiple devices may include overlapping components. The components listed in any of the figures herein are exemplary, and may be included a stand-alone device or may be included, in whole or in part, as a component of a larger device or system.

The concepts disclosed herein may be applied within a number of different devices and computer systems, including, for example, general-purpose computing systems, server-client computing systems, mainframe computing systems, telephone computing systems, laptop computers, cellular phones, personal digital assistants (PDAs), tablet computers, video capturing devices, wearable computing devices (watches, glasses, etc.), other mobile devices, video game consoles, speech processing systems, distributed computing environments, etc. Thus the components, components and/or processes described above may be combined or rearranged without departing from the present disclosure. The functionality of any component described above may be allocated among multiple components, or combined with a different component. As discussed above, any or all of the components may be embodied in one or more general-purpose microprocessors, or in one or more special-purpose digital signal processors or other dedicated microprocessing hardware. One or more components may also be embodied in software implemented by a processing unit. Further, one or more of the components may be omitted from the processes entirely.

The above embodiments of the present disclosure are meant to be illustrative. They were chosen to explain the principles and application of the disclosure and are not intended to be exhaustive or to limit the disclosure. Many modifications and variations of the disclosed embodiments may be apparent to those of skill in the art. Persons having ordinary skill in the field of computers and/or digital imaging should recognize that components and process steps described herein may be interchangeable with other components or steps, or combinations of components or steps, and still achieve the benefits and advantages of the present disclosure. Moreover, it should be apparent to one skilled in the art, that the disclosure may be practiced without some or all of the specific details and steps disclosed herein.

Aspects of the disclosed system may be implemented as a computer method or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid-state memory, flash drive, removable disk and/or other media. Some or all of the components described above may be implemented by a digital signal processor (DSP).

Embodiments of the present disclosure may be performed in different forms of software, firmware and/or hardware. Further, the teachings of the disclosure may be performed by an application specific integrated circuit (ASIC), field programmable gate array (FPGA), or other component, for example.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list.

Conjunctive language such as the phrase "at least one of X, Y and Z," unless specifically stated otherwise, is to be understood with the context as used in general to convey that an item, term, etc. may be either X, Y, or Z, or a combination thereof. Thus, such conjunctive language is not generally intended to imply that certain embodiments require at least one of X, at least one of Y and at least one of Z to each is present.

As used in this disclosure, the term "a" or "one" may include one or more items unless specifically stated otherwise. Further, the phrase "based on" is intended to mean "based at least in part on" unless specifically stated otherwise.

What is claimed is:

1. A computer-implemented method, the method comprising, by a device:

receiving a plurality of audio signals that include a first audio signal corresponding to a first direction and a second audio signal corresponding to a second direction;

determining a plurality of signal-to-noise ratio (SNR) values including a first SNR value corresponding to a portion of the first audio signal that is within a first frequency band;

selecting, using the plurality of SNR values, a first number of audio signals of the plurality of audio signals, the first number of audio signals including the first audio signal, wherein the selecting further comprises:

determining a highest SNR value of the plurality of SNR values within the first frequency band;

determining a threshold SNR value corresponding to the first frequency band by multiplying a fixed value by the highest SNR value;

determining that the first SNR value exceeds the threshold SNR value;

increasing a first counter value for the first audio signal, the first counter value being one of a plurality of counter values;

determining a first number of highest counter values from the plurality of counter values; and selecting the first number of audio signals having the first number of highest counter values;

determining that a third audio signal of the first number of audio signals has a highest counter value of the plurality of counter values;

determining a target angle value indicating a third direction corresponding to the third audio signal;

determining a phase value for the portion of the first audio signal, the phase value indicating a phase shift between a first angle value of the first audio signal and the target angle value;

determining a group SNR value by summing a first number of SNR values of the plurality of SNR values, wherein the first number of SNR values correspond to both the first number of audio signals and the first frequency band;

determining a first scaling value for the portion of the first audio signal, the first scaling value indicating a ratio of the first SNR value to the group SNR value; and generating an output audio signal using the first scaling value, the phase value, and the portion of the first audio signal.

2. The computer-implemented method of claim 1, wherein generating the output audio signal further comprises:

generating a first coefficient value using the phase value;

generating a first portion of the output audio signal by multiplying the first scaling value, the first coefficient value, and the portion of the first audio signal;

generating a second coefficient value using a second phase value for a portion of the third audio signal that is within the first frequency band;

determining a second scaling value for the portion of the third audio signal, the second scaling value indicating a ratio of a third SNR value of the portion of the third audio signal to the group SNR value;

generating a second portion of the output audio signal by multiplying the second scaling value, the second coefficient value, and the portion of the third audio signal; and generating the output audio signal by combining the first portion of the output audio signal and the second portion of the output audio signal.

3. The computer-implemented method of claim 1, wherein determining the plurality of SNR values further comprises:

determining, using a first time constant, a first energy value of the portion of the first audio signal that is within the first frequency band;

determining, using the first time constant, a second energy value of a portion of the second audio signal that is within the first frequency band;

determining, during a first time period, that playback audio is being generated by one or more loudspeakers of the device;

determining that the second energy value is lowest of a plurality of energy values associated with the first frequency band; and determining the first SNR value by dividing the first energy value by the second energy value.

4. The computer-implemented method of claim 3, further comprising:

determining, during a second time period, that the playback audio is not being generated by the one or more loudspeakers;

determining, using the first time constant, a third energy value corresponding to a second portion of the first audio signal that is within the first frequency band and associated with the second time period;

determining, using a second time constant that is different than the first time constant, a fourth energy value corresponding to the second portion of the first audio signal; and determining a second SNR value by dividing the third energy value by the fourth energy value.

5. A computer-implemented method, the method comprising:

receiving a plurality of audio signals that includes a first audio signal corresponding to a first direction and a second audio signal corresponding to a second direction;

determining a first signal quality metric value corresponding to a portion of the first audio signal that is within a first frequency band;

determining a second signal quality metric value corresponding to a portion of the second audio signal that is within the first frequency band;

determining, using the first signal quality metric value and the second signal quality metric value, a first number of audio signals of the plurality of audio signals, the first number of audio signals including the first audio signal;

determining a first value corresponding to the portion of the first audio signal, the first value representing a ratio of the first signal quality metric value to a sum of signal quality metric values that are associated with the first number of audio signals and the first frequency band;

determining a second value representing a first phase shift of the portion of the first audio signal, the second value determined using a first angle associated with the first direction and a target angle associated with the first number of audio signals; and generating an output audio signal using the first value, the second value, and the first number of audio signals.

6. The computer-implemented method of claim 5, wherein generating the output audio signal further comprises:

generating a first coefficient value using the second value;

generating a first portion of the output audio signal by multiplying the first value, the first coefficient value, and the portion of the first audio signal;

determining a third value corresponding to the portion of the second audio signal, the third value representing a ratio of the second signal quality metric value to the sum of signal quality metric values;

determining a fourth value representing a second phase shift of the portion of the second audio signal, the fourth value determined using a second angle associated with the second direction and the target angle;

generating a second coefficient value using the fourth value;

generating a second portion of the output audio signal by multiplying the third value, the second coefficient value, and the portion of the second audio signal; and generating the output audio signal by combining the first portion of the output audio signal and the second portion of the output audio signal.

7. The computer-implemented method of claim 5, wherein determining the first number of audio signals further comprises:

determining that the first signal quality metric value exceeds a first threshold value;

incrementing a first counter value for the first audio signal;

determining that the second signal quality metric value does not exceed the first threshold value;

determining a third signal quality metric value corresponding to a portion of a third audio signal that is within a second frequency band;

determining that the third signal quality metric value exceeds a second threshold value; and incrementing a second counter value for the third audio signal.

8. The computer-implemented method of claim 7, wherein determining the first number of audio signals further comprises:

determining a first number of highest counter values from a plurality of counter values, the plurality of counter values including the first counter value and the second counter value; and using the first number of highest counter values to determine the first number of audio signals.

9. The computer-implemented method of claim 5, wherein determining the second value further comprises:

selecting a third audio signal of the first number of audio signals;

identifying the target angle corresponding to the third audio signal;

determining a steering vector using the target angle;

determining a beamformer filter associated with a first portion of the first audio signal; and determining the second value using the beamformer filter and the steering vector.

10. The computer-implemented method of claim 5, wherein determining the first signal quality metric value further comprises:

determining, during a first time period, that audio data is being sent to one or more loudspeakers;

determining, using a first time constant, a first energy value corresponding to the portion of the first audio signal;

determining, using the first time constant, a second energy value corresponding to the portion of the second audio signal;

determining that the second energy value is lowest of a plurality of energy values associated with the plurality of audio signals and the first frequency band; and determining the first signal quality metric value using the first energy value and the second energy value.

11. The computer-implemented method of claim 10, further comprising:

determining, during a second time period, that the audio data is not being sent to the one or more loudspeakers;

determining, using the first time constant, a third energy value corresponding to a second portion of the first audio signal that is within the first frequency band and associated with the second time period;

determining, using a second time constant that is different than the first time constant, a fourth energy value corresponding to the second portion of the first audio signal; and determining a third signal quality metric value using the third energy value and the fourth energy value.

12. The computer-implemented method of claim 5, further comprising:

determining a third signal quality metric value corresponding to a portion of a third audio signal of the plurality of audio signals, the portion of the third audio signal being within the first frequency band;

determining, using the third signal quality metric value, a threshold value;

determining that the first signal quality metric value is below the threshold value; and setting the first value equal to a value of zero.

13. A system comprising:

at least one processor; and memory including instructions operable to be executed by the at least one processor to cause the system to:

receive a plurality of audio signals that includes a first audio signal corresponding to a first direction and a second audio signal corresponding to a second direction;

determine a first signal quality metric value corresponding to a portion of the first audio signal that is within a first frequency band;

determine a second signal quality metric value corresponding to a portion of the second audio signal that is within the first frequency band;

determine, using the first signal quality metric value and the second signal quality metric value, a first number of audio signals of the plurality of audio signals, the first number of audio signals including the first audio signal;

determine a first value corresponding to the portion of the first audio signal, the first value representing a ratio of the first signal quality metric value to a sum of signal quality metric values that are associated with the first number of audio signals and the first frequency band;

determine a second value representing a first phase shift of the portion of the first audio signal, the second value determined using a first angle associated with the first direction and a target angle associated with the first number of audio signals; and generate an output audio signal using the first value, the second value, and the first number of audio signals.

14. The system of claim 13, wherein the memory further comprises instructions that, when executed by the at least one processor, further cause the system to:

generate a first coefficient value using the second value;

generate a first portion of the output audio signal by multiplying the first value, the first coefficient value, and the portion of the first audio signal;

determine a third value corresponding to the portion of the second audio signal, the third value representing a ratio of the second signal quality metric value to the sum of signal quality metric values;

determine a fourth value representing a second phase shift of the portion of the second audio signal, the fourth value determined using a second angle associated with the second direction and the target angle;

generate a second coefficient value using the fourth value;

generate a second portion of the output audio signal by multiplying the third value by the second coefficient value and the portion of the second audio signal; and generate the output audio signal by combining the first portion of the output audio signal and the second portion of the output audio signal.

15. The system of claim 13, wherein the memory further comprises instructions that, when executed by the at least one processor, further cause the system to:

determine that the first signal quality metric value exceeds a first threshold value;

increment a first counter value for the first audio signal;

determine that the second signal quality metric value does not exceed the first threshold value;

determine a third signal quality metric value corresponding to a portion of a third audio signal that is within a second frequency band;

determine that the third signal quality metric value exceeds a second threshold value; and increment a second counter value for the third audio signal.

16. The system of claim 15, wherein the memory further comprises instructions that, when executed by the at least one processor, further cause the system to:

determine a first number of highest counter values from a plurality of counter values, the plurality of counter values including the first counter value and the second counter value; and use the first number of highest counter values to determine the first number of audio signals.

17. The system of claim 13, wherein the memory further comprises instructions that, when executed by the at least one processor, further cause the system to:

select a third audio signal of the first number of audio signals;

identify the target angle corresponding to the third audio signal;

determine a steering vector using the target angle;

determine a beamformer filter associated with a first portion of the first audio signal; and determine the second value using the beamformer filter and the steering vector.

18. The system of claim 13, wherein the memory further comprises instructions that, when executed by the at least one processor, further cause the system to:

determine, during a first time period, that audio data is being sent to one or more loudspeakers;

determine, using a first time constant, a first energy value corresponding to the portion of the first audio signal;

determine, using the first time constant, a second energy value corresponding to the portion of the second audio signal;

determine that the second energy value is lowest of a plurality of energy values associated with the plurality of audio signals and the first frequency band; and determine the first signal quality metric value using the first energy value and the second energy value.

19. The system of claim 18, wherein the memory further comprises instructions that, when executed by the at least one processor, further cause the system to:

determine, during a second time period, that the audio data is not being sent to the one or more loudspeakers;

determine, using the first time constant, a third energy value corresponding to a second portion of the first audio signal that is within the first frequency band and associated with the second time period;

determine, using a second time constant that is different than the first time constant, a fourth energy value corresponding to the second portion of the first audio signal; and determine a third signal quality metric value using the third energy value and the fourth energy value.

20. The system of claim 13, wherein the memory further comprises instructions that, when executed by the at least one processor, further cause the system to:

determine a third signal quality metric value corresponding to a portion of a third audio signal of the plurality of audio signals, the portion of the third audio signal being within the first frequency band;

determine, using the third signal quality metric value, a threshold value;

determine that the first signal quality metric value is below the threshold value; and set the first value equal to a value of zero.

* * * * *